United States Patent [19]

Brunner

[11] Patent Number: 4,852,485

[45] Date of Patent: Aug. 1, 1989

[54] METHOD OF OPERATING AN AUTOTYPICAL COLOR OFFSET PRINTING MACHINE

[76] Inventor: Felix Brunner, CH-6677 Corippo (Tl), Switzerland

[21] Appl. No.: 841,947

[22] Filed: Mar. 20, 1986

[30] Foreign Application Priority Data

| | | | |
|---|---|---|---|
| Mar. 21, 1985 | [DE] | Fed. Rep. of Germany | 3510172 |
| Dec. 9, 1985 | [DE] | Fed. Rep. of Germany | 3543444 |
| Feb. 11, 1986 | [DE] | Fed. Rep. of Germany | 3604222 |
| Feb. 14, 1986 | [EP] | European Pat. Off. | 86101892.7 |

[51] Int. Cl.[4] ..... B41F 31/04; B41F 7/06

[52] U.S. Cl. ..... 101/211; 101/365; 101/181; 101/DIG. 45

[58] Field of Search ..... 101/365, 350, DIG. 45, 101/DIG. 47, 211, 181, 183, 182, 177, 136, 137, 138, 139, 206, 207; 250/571, 559, 226; 356/402, 425

[56] References Cited

U.S. PATENT DOCUMENTS

| | | | |
|---|---|---|---|
| 3,835,777 | 9/1974 | Krygeris | 101/350 |
| 4,200,932 | 4/1980 | Schramm et al. | 364/519 |
| 4,310,248 | 12/1982 | Meredith | 356/243 |
| 4,606,633 | 8/1986 | Jeschke et al. | 356/237 |
| 4,667,596 | 5/1987 | Dotzel et al. | 101/211 |

FOREIGN PATENT DOCUMENTS

| | | | |
|---|---|---|---|
| 1206803 | 7/1986 | Canada . | |
| 124908 | 11/1984 | European Pat. Off. | 101/365 |

OTHER PUBLICATIONS

Graphic Arts Japan, vol. 26, 1984–1985, pp. 26–31, Japan Printer's Association; Tatsuo Kunishi: "Estimation of Values of Primary Inks in Color Prints".

*Primary Examiner*—J. Reed Fisher

[57] ABSTRACT

The invention relates to a method, a control apparatus and aids for the achievement of a uniform printing result on an autotypically operating multicolor printing press. In addition to solid densities and/or screen dot sizes, selected relationships between solid densities and/or screen dot sizes of different printing colors are determined at measuring patches simultaneously printed within the color zones. If they fall outside of the tolerances associated with them, a corrective intervention is made in the printing process by actuating the regulators of the inking units. For the control of the inking units, the first aid provided, instead of the conventional single color meausring patches, is combination measuring patches which are formed by the overprinting of single color measuring patches. Since the measurement data obtained at combination measuring patches do not agree with the data obtained at single color measuring patches, they are corrected accordingly prior to being processed to control signals for the regulators in the printing units. A second aid consists of a device for determining the color balance in the printing result.

18 Claims, 10 Drawing Sheets

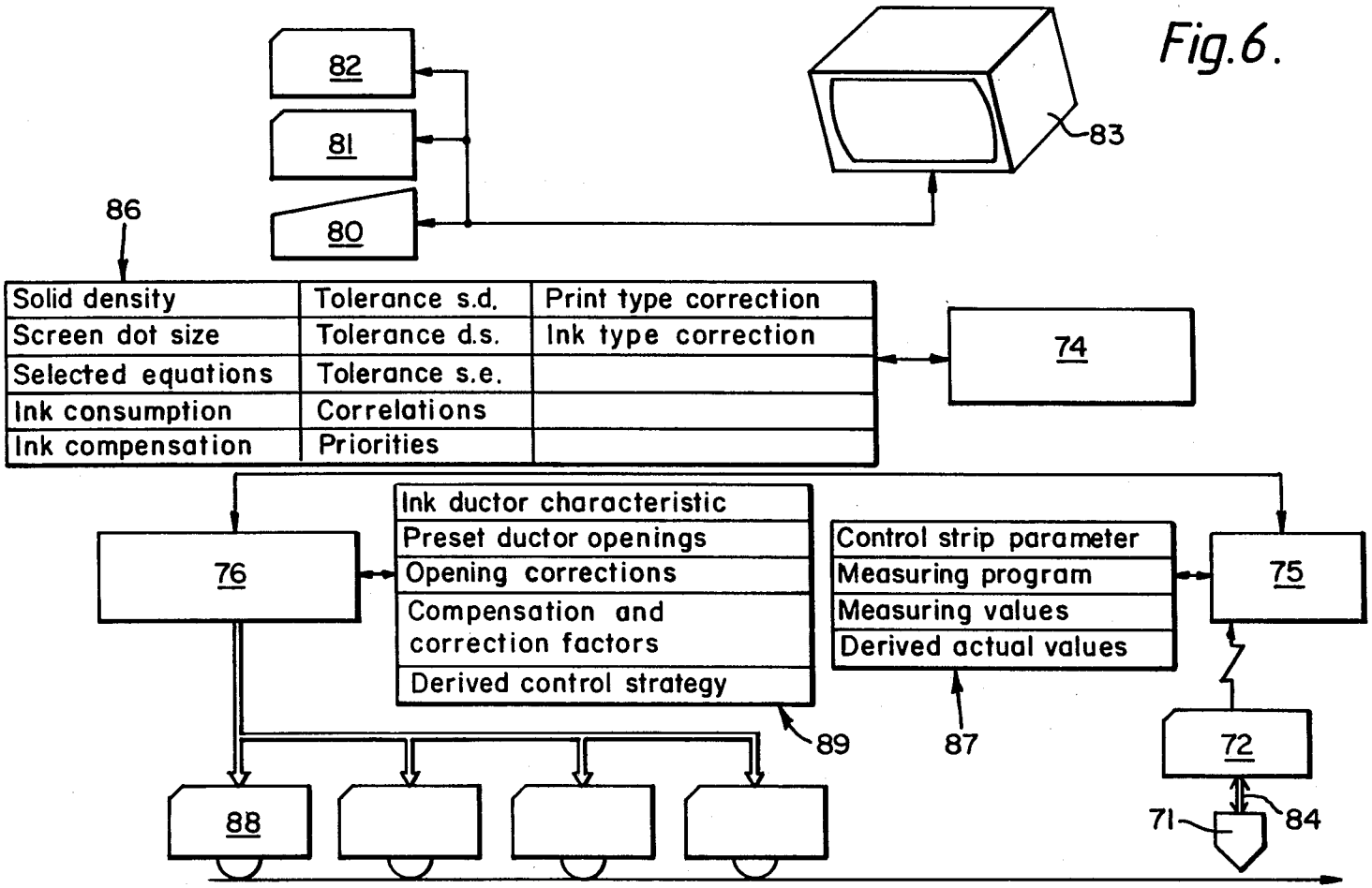
Fig. 6.
83
82
81
80
86
Solid density
Screen dot size
Selected equations
Ink consumption
Ink compensation
Tolerance s.d.
Tolerance d.s.
Tolerance s.e.
Correlations
Priorities
Print type correction
Ink type correction
74
75
76
Ink ductor characteristic
Preset ductor openings
Opening corrections
Compensation and correction factors
Derived control strategy
89
Control strip parameter
Measuring program
Measuring values
Derived actual values
87
72
84
71
88

Fig.10.

| | | | |
|---|---|---|---|
| C | 48% | 48% | 48% |
| M | 38% | 40% | 42% |
| Y | 40% | 40% | 40% |
| C | 50% | 50% | 50% |
| M | 38% | 40% | 42% |
| Y | 40% | 40% | 40% |
| C | 52% | 52% | 52% |
| M | 38% | 40% | 42% |
| Y | 40% | 40% | 40% |

Fig.11.

| | | | |
|---|---|---|---|
| C | 0.51 | 0.51 | 0.51 |
| M | 0.40 | 0.42 | 0.44 |
| Y | 0.42 | 0.42 | 0.42 |
| C | 0.54 | 0.54 | 0.54 |
| M | 0.40 | 0.42 | 0.44 |
| Y | 0.42 | 0.42 | 0.42 |
| C | 0.57 | 0.57 | 0.57 |
| M | 0.40 | 0.42 | 0.44 |
| Y | 0.42 | 0.42 | 0.42 |

Fig.12.

| | | | |
|---|---|---|---|
| C | 73% | 73% | 73% |
| M | 63% | 65% | 67% |
| Y | 65% | 65% | 65% |
| C | 75% | 75% | 75% |
| M | 63% | 65% | 67% |
| Y | 65% | 65% | 65% |
| C | 77% | 77% | 77% |
| M | 63% | 65% | 67% |
| Y | 65% | 65% | 65% |

Fig.13.

| | | | |
|---|---|---|---|
| C | 0.57 | 0.57 | 0.57 |
| M | 0.59 | 0.62 | 0.64 |
| Y | 0.64 | 0.65 | 0.66 |
| C | 0.59 | 0.59 | 0.59 |
| M | 0.60 | 0.61 | 0.63 |
| Y | 0.64 | 0.64 | 0.65 |
| C | 0.61 | 0.61 | 0.61 |
| M | 0.60 | 0.62 | 0.64 |
| Y | 0.54 | 0.65 | 0.66 |

METHOD OF OPERATING AN AUTOTYPICAL COLOR OFFSET PRINTING MACHINE

BACKGROUND OF THE INVENTION

The invention relates to a method, a control device and aids for the achievement of uniform printing results on an autotypically working color offset printing machine. In such machine the feed of printing inks to adjacent color zones of a printing substrate is adjustable by means of regulators and for the regulation of the printing process, solid densities and/or screen dot sizes are determined repeatedly on measuring patches simultaneously printed within the color zones, and, when they fall outside of tolerances associated with them, intervention is made correctively in the printing process.

Polychrome originals are today reproduced mostly by a four-color printing process wherein four primary colors, usually cyan, magenta, yellow and black are used. The originals are first broken down into so-called color separations, which are then converted to printing forms. These consist of offset printing plates produced, for example, by means of halftone films.

The brightness steps or tone value steps of a printed color are obtained in the case of autotypical multicolor printing by representing the original on the printing form of each color separation by a great number of printing screen dots having a different size or area coverage per unit of printing area. Each surface coverage corresponds to a brightness step, and the sum of all brightness steps gives the tone value scale which is defined at the dark end by a screen dot area of 100%, corresponding to a unit area uniformly covered with printing ink, and at the light end by a screen dot area coverage of 0% of the whitest color of the medium (e.g., paper). On the other hand, the so-called color shades are obtained by the precise overprinting of the screened color separations of the original, on the basis of a so-called autotypical color mixing, which is a combination of additive and subtractive color mixing, since the screen dots are located partially one over the other and partially beside one another on the paper. By maintaining recommended and partially standardized angles at which the screen dots are printed one over the other in the screens of the different printing plates it is brought about that no substantial color variations can be caused by varying proportions of superimposed and side-by-side screen dots.

In modern multicolor offset printing machines, the inks are printed in rapid succession onto the paper, a separate inking unit being provided for each ink. If, for example, 10 brightness steps are provided for each printing ink, 1000 different shades of color can be obtained with three printing inks. The reproduction of a color shade depends essentially on two factors, namely, on the thickness of the printing ink film on the paper, on the one hand, and, on the other hand, on the above-mentioned area coverage of the screen dots. For the control of these factors, the inking units of the printing mechanisms of the multicolor offset printing machine are provided each with an ink fountain and a plurality of regulators in the form of so-called ink keys or ducts whereby the supply of ink to adjacent color zones (or longitudinal strips) of the printing forms or paper can be adjusted individually. As a rule, an increase of the ink feed is associated both with a vertically oriented increase of the ink film thickness and with a horizontally oriented spreading or increase of the area coverage of the screen dots, while a reduction of the ink feed leads to a corresponding reduction of the ink film thickness and the area coverage of the screen dots.

For the control of the printing processes, mainly three aids are used today. The first aid consists in performing optical density measurements by means of manually operated or automatic densitometers at preselected measurement areas in the form of screen patches and/or solid patches, i.e., surfaces completely covered with printing ink. The screen patches and solid patches can be parts of the printed picture itself, or they can be produced by providing separate patches on the printing form. The densitometric evaluation performed on a solid patch results in a value to be referred to hereinafter as the solid density, while the densitometric evaluation of a screen patch results in a value to be referred to hereinafter as the screen density. The density values give information on changes in the ink film thickness or on the size of the screen dots. The second aid consists in providing the printing forms with special control elements which consist of different sizes of screen dots and different sizes of micromeasuring elements which disappear or are retained in the printing and thus permit a direct quantitative evaluation of the variation of the screen dots or their size. Separate density measurements are not necessary, but they can be performed additionally. The control elements are provided, like the measuring patches, preferably at the top or bottom margin of the printing form or print, special control elements or measuring patches being best associated with each inker regulator and thus with each color zone of the printed picture, and furthermore special control elements or measuring patches are associated with each color separation. Lastly, the third aid consists in the use of semiautomatic or fully automatic control devices, especially in conjunction with multicolor offset printing presses. These control devices are based on the principle of using manually operated or automatically operating densitometers to measure the screen densities and/or solid densities of printed screen patches and/or solid patches, comparing the measured densities with standard values or tolerance ranges and, in the case of departures of the determined densities from the standard values or tolerances ranges, to operate the actuators of the inking mechanisms such that the measured densities will return to their proper value or come within the tolerances. In contrast to the other two aids, whose main purpose is to check the printing result, the third aid is also aimed at changing the printing result if the measured values differ from the specified values. In automatic control apparatus, this is accomplished as follows: the densities obtained with densitomers are fed to an electronic data processing apparatus equipped with microprocessors, compared in this apparatus with preselected values or tolerance ranges and, if the differences are out of tolerance, they are used for the computation of an actuating signal which serves for the automatic adjustment of the corresponding regulator, which is, for example, a key which can be turned by a stepper motor.

In making a multicolor print, the pressman can therefore proceed essentially as follows:

The pressman first begins to print at a low ink feed in order to coordinate the, for example, four printing inks such that a perfect fit results, which is important to the sharpness of the printed picture. The pressman then attempts to control the finished print result by controlling the feed of the printing inks to the color zones by means of the regulators such that it will approach the original on hand, which can be a test print, known in technical language as a proof, or it can also be the same model that served for the production of the color separations. The matching of the print result to the original is performed mainly by feel and on the basis of visual comparison of the original and the print, i.e., by subjective criteria. By constant corrections of the regulators of the inking mechanisms, the attempt is made to come ever closer to the original, or to keep the results obtained constant through the duration of the printing run. It is no more possible to achieve complete visual identity between the print and the original than it is to achieve uniform printing results over a long period of time. What color and shade differences remain is subject to a great extent to the subjective perceptions of the pressman or the client, who often is present at the beginning of a production run. Control of the printing result is therefore time-consuming and inaccurate.

To rule out the subjectivity of impressions perceived in the inspection of the printing result, the pressman can use the above-mentioned measuring patches and control elements and evaluate them continually. Alternatively, the pressman can provide a semiautomatic or fully automatic control system and intervene to help it occasionally when even the control system is no longer able to maintain identity between the original and the print.

All these measures and aids for the attainment of a uniform printing result suffer from three main disadvantages.

First, all that is available for corrective intervention in the printing process is the inking mechanisms of the multicolor printing machine or the sum of the regulators controlling the feed of ink. Therefore, the ink film thicknesses and screen dot areas can only be changed all together, not independently of one another, since varying the setting of a key or the like results not only in a change in the ink film thickness, but always also in a change in the area of the screen dots in the color zones in question. As a result, both the measured values of the solid densities and the measured values of the screen densities vary whenever a corrective intervention is made in the printing process.

Secondly, there is no clear or constant relationship between changes in the ink film thickness and changes in the dot area coverage, since the correlation between changes in screen densities and changes in solid densities constantly varies in the course of a printing process. It is to be noted that changes in the ink film thickness have a great influence on the brightness steps within a given printing color and a slight influence on the color shades formed by the interaction of several printing inks, while the reverse is true of changes in the area coverage of the screen dots. Any kind of fixed relationship or correlation between these changes has hitherto been found only for periods of time to be measured in minutes, i.e., no more than short-term relationships. For the long-term relationships measured in hours, which are especially important for production runs, however, considerable variations are found in the correlations between changes in the solid densities and the screen densities. The reason for this is to be found in the rheology of the printing inks and thus in their tendency to form screen dots of different size under the influence of heat and the feed of dampening water. However, oxidation processes and other phenomena also have an effect on the correlations. This can go so far that, in one border zone in a long production run, for example, only comparably small changes in the screen dot area coverage can be produced even by very great changes in the printing ink feed combined with a great change in the ink film thickness, while in another border zone in the same long production run, small changes in the ink feed and ink film thickness produce great changes in the area coverage of the screen dots. In these cases the most important factor to be heeded in the printing process, namely the color balance, is changed or affected differently. As a result, the action of the above-described aids, especially the control methods and apparatus (although the latter are of considerable help to the pressman since they operate on the basis of objective criteria), are actually based on one of two of the heretofore possible compromises, namely the establishment of either narrow or comparatively great tolerance ranges of screen densities and/or solid densities. If narrow tolerances are established, the color balance can be held in the short term to a sufficiently constant value. The printing run, however, must be frequently interrupted, because changes in the correlation between the screen densities and solid densities will in the long run soon cause departures from the tolerances or the control apparatus will become uncontrollable, because adjustments of the regulators will no longer permit the variation of the area coverage of the screen dots that is needed to sustain the color balance. If, however, wide tolerances are established, control of the color balance is virtually abandoned because the human eye is very sensitive to color shade changes based on changes in the screen dot area, and therefore, on the basis of the present knowledge, the screen densities and the dot areas should remain as unvarying as possible. Overall, therefore, the achievement of a uniform printing result is still today encumbered by many deficiencies.

Thirdly, considerable problems are encountered with regard to the shape, arrangement, number and size of the measuring patches. The regulators of common printing presses have widths between 30 mm and 40 mm, so that color zones of corresponding width are formed, while a great number of regulators and color zones are arrayed contiguously with one another. As a result, all of the measuring patches have to be contained within a width of 30 mm to 40 mm, inasmuch as each individual color zone must be examined, evaluated and regulated independently of adjacent color zones, as is desirable in modern printing presses.

The size and the arrangement of the measuring patches are subject in practice to two limitations. On the one hand they must have a certain minimum size to enable the measuring spot of a densitometer to be situated at least for a period of time completely within each measuring patch, even when the measurements are made on continuous-feed offset paper (roll paper) moving at high speed instead of a sheet that is not moving (sheet-fed offset paper). On the other hand, the areas of paper that carry the measuring patches are cut off at the end of the printing process, so that they constitute waste which has to be minimized for reason of economy.

In normal four-color printing using three chromatic inks (magenta, cyan and yellow) and one achromatic ink (black), if measuring patches in the form of screen patches as well as measuring patches in the form of solid patches are to be used, at least six measuring patches, but preferably eight, must be provided in each of the color zones for the chromatic inks, so that the achromatic ink can also be controlled. Furthermore, additional control means in the form of microline patches, balance patches, trapping patches or the like must be present, which are not needed for the regulation, but are useful in analyzing the printing. At least 10 measuring patches and control elements would be desirable for each color zone.

On high-speed web printing presses the measuring patches should have a width of 6 mm to 8 mm, to obtain reliable measurements. If ten measuring patches are used, this would require space amounting to 60 mm to 80 mm in width, which is more than about twice the actual width of a color zone. If the ten measuring patches were arranged in a double row, the amount of waste would nearly double, which is undesirable for economic reasons alone. Until now, therefore, regulation has been performed with screen patches alone or with solid patches alone, so that only a total of six measuring patches are needed per color zone, and all measuring patches can be contained in a single row.

It is the object of the invention to develop a new strategy for the achievement of uniform printing results, and to design the method and the control apparatus of the kinds specified above so as to permit a flexible control and regulation of the printing process, yet one subject to close tolerances as regards color balance.

It is another object of the invention to propose an aid for the constant control and supervision of the printing result in the form of a set of single color strips for the regulation of multicolor offset printing presses such that no space problems will result in the simultaneously printed print control strip, and that little waste of the printed paper will be involved, even though the control is achieved with the aid of screen patches as well as with the aid of solid patches. Moreover, it is to be possible to provide additional measuring patches or control elements without thereby impairing the evaluation of the measuring patches intended for the regulation of the printing results.

Lastly, it is an object of the invention to propose an additional aid for the control of a multi-color printing press in the form of an apparatus to permit a visual determination of the color balance in the printing results. This apparatus is furthermore to help the pressman to determine the degree of difficulty involved in the printing of a picture, and to establish reasonable tolerance ranges for the solid densities and/or screen dot sizes and/or selected equations*, on the basis of the particular economic and technical possibilities involved. 6 *Also referred to herein as "selected relationships."

BRIEF SUMMARY OF THE INVENTION

According to the invention to sustain the color balance selected relationships of solid densities and/or screen dot sizes of different inks with one another are repeatedly determined during the printing process, and when the selected relationships fall outside of the tolerance associated with them, intervention is made correctively in the printing process.

The invention sets out from the knowledge that the color balance depends not only on the absolute values of the ink film thicknesses and of the area covered by the screen dots, but also on the relationships among the dot areas and/or ink film thicknesses measured in a color zone for different inks, and on the screen densities and/or solid densities resulting therefrom. In other words, a color shade formed, for example, of cyan and magenta will change but slightly if within the half-tone step in question the screen dots both of the cyan and of the magenta are changed in the same direction on the basis of changed printing conditions and, for example, increase from 50% dot area coverage to 55% dot area coverage for cyan and from 40% to 45% for magenta. In such a case it is mostly the brightness of the color shade, not the shade itself, that should change. On the other hand, the color shade itself would principally change if the dot area coverages or the screen densities of the half-tone dots are varied in different directions and, for example, the dot area coverage of cyan is increased from 50% to 55%, while at the same time the dot area coverage for magenta is decreased from 40% to 35%. The new strategy for the attainment of a uniform printing result therefore first takes into account that selected equations of the screen densities of the screen dots and/or solid densities must be kept within preselected, narrow tolerance ranges, in order thereby to largely tolerate changes in the same direction in the printing inks participating in the formation of a color zone, but to keep changes in opposite directions within close limits. Since the human eye can distinguish only about 50 different brightness steps in one given color shade, but about 1 million different color shades, a change which this entails in the brightness of the color shades is less critical than a change in the color shade itself. Aside from this, the new strategy brings with it the important advantage that the tolerance ranges of the absolute values of the solid densities or screen densities can be increased substantially in comparison with the former methods. A restriction of these absolute values serves only to maintain the contrast in the printing result. For although the human eye reacts less sensitively to brightness variations than it does to color variations, the brightness variations are nevertheless not entirely negligible, since the overall contrast is determined by the solid densities and the color of the paper, whereas it is desirable to limit the absolute values of the screen densities or of the size of the screen dots, because it is by them that the color shades in the printing result are established. Since in half-tone printing the changes in the dots are based on largely known principles, it is nevertheless usually sufficient to measure for each printing ink, and in some cases for each color zone, only one halftone step, e.g., the 50% step, and to establish a tolerance range for it.

Lastly, if the special equations established by measurements made on combination measuring patches are applied, the surprising advantage is gained that the variations are considerably less in relation to those based on the primary colors than the variations are in the case of the absolute values of the screen dots or solid densities. Therefore, approximation formulas or comparative testing in conjunction with the selected equations lead to corrected measurement values which are an excellent basis for a regulating process.

The invention offers the advantage that, if three chromatic printing inks are available for each color zone, all that is needed is a single combination measuring patch to obtain information on the solid densities or screen dot sizes of all participating inks by densitometric evaluation. Even if each combination measuring patch is given a width of about 8 mm, and if one combination measuring patch each is provided in the form of a solid patch as well as in the form of a screen patch, a space about 16 mm wide is needed within each color zone in order to obtain all of the information on the solid densities and screen dot sizes of all chromatic printing inks. Therefore there is always sufficient space left to accommodate additional measuring patches and control elements in each color zone. Alternatively, provision can also be made for printing no more than two single-color measuring patches one on the other to form a combination measuring patch, so that a total of four combination measuring patches will appear in each color zone, requiring in the above example a width of about 32 mm.

The scanning of the combination measuring elements of the invention with densitomers leads to relatively inaccurate values in comparison with those which are obtained from single-color measuring patches. Consequently, persons skilled in the art have basically avoided obtaining the information needed for the control of a multicolor offset printing press from combination measuring patches, i.e., so-called mixed colors. A reason for the erroneous readings is to be seen in the fact that densitometers are not colorimeters, and are not suitable for colorimetric determinations. Densitometers are designed for the purpose of measuring the color densities of primary colors which are printed separately; a suitable complementary filter is associated with each primary color, although no international agreements exist with regard to the selection of these color filters. If, however, mixed colors which are formed by the printing of several primary colors one on the other are scanned with a densitometer using such color filters, the result will be that the readings obtained will agree very poorly with those readings that are obtained in the same manner from separately printed primary colors. This poor agreement is attributed to so-called secondary color adsorptions and other causes, and has heretofore obstructed the use of combination measuring patches for regulating purposes.

On the other hand, the invention is based on the surprising discovery that the variations obtained by the use of combination measuring patches are, as a rule, subject to certain laws. It is therefore possible to develop approximation formulas by means of which the erroneous readings can be recomputed to corrected readings which will correspond fairly accurately to the readings obtained at single-color measuring patches. Aside from that, it is possible to prepare color tables or chromaticity diagrams with corresponding mixed colors, which, in addition to the readings obtained on combination measuring patches, contain the correct readings obtained at single-color measuring patches so that, by comparing the erroneous readings obtained during printing with the color tables or chromaticity diagrams, it will be easy to obtain the corrected values to serve as the basis of the regulating process. Such comparisons can be performed automatically, for example, by means of a computer.

The apparatus for determining the color balance in the printing result offers the advantage that the pressman is able to relate visually the gray shades, brown shades or other mixed shades of the combination measuring patches of the print control strip directly with a corresponding control element of the apparatus. If the apparatus is designed properly, it will then easily be possible to estimate or read the deviations from a defined neutral point which have occurred in the course of the printing process and adjust the inking units of the press to remedy these deviations.

According to another feature of the invention, the regulators are operated on the basis of the momentary correlation between the changes in the screen densities and/or solid densities. Thus allowance is made for the circumstance that these correlations can vary in the course of the printing process, i.e., a given change in the ink film thickness can be connected with different changes in the screen dot size. Another important advantage of the strategy according to the invention for sustaining a uniform printing result thus consists in the fact that the regulating process is rendered more flexible and is kept adjustable by constant adaptation to the changing correlations over long periods of time.

Additional features of the invention will be found in the subordinate claims.

The invention will be further explained below by embodiments, in conjunction with the appended drawing and the appended color samples.

BRIEF DESCRIPTION OF THE DRAWING

FIG. 6 shows additional details of the control apparatus of FIG. 5, FIGS. 10 to 13 are four extracts from color tables.

DESCRIPTION OF PREFERRED EMBODIMENTS

Figure 1:
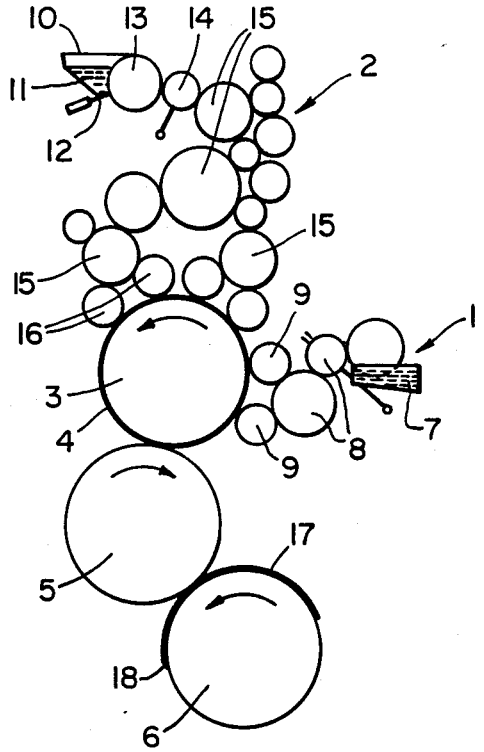
FIG. 1 is a diagrammatic side view of a single inking unit of an offset printing press.

According to FIG. 1, a conventional multicolor offset printing press contains several printing units each having a moistening unit 1, an inking unit 2, a plate cylinder 3 around which a printing form 4 bearing the picture to be printed, e.g., a printing plate consisting of aluminum, is clamped, a blanket roll 5 and a printing cylinder 6.

The moistening unit 1 serves to coat the printing forms or plates first with a thin, uniform film of water, and for this purpose has a reservoir 7 from which water is fed by means of cloth-covered rubber rollers 8 to two applicator rollers 9 which engage the printing form 4 with light pressure and keep them constantly moist.

The inking unit 2 serves the purpose of supplying the printing form 4 constantly with the necessary amount of ink. For this purpose it has an ink fountain 10 serving for the storage of a printing ink 11, on which a plurality of regulators 12 in the form of keys are mounted. These regulators 12 are distributed at uniform intervals over the entire width of the ink fountain and control the feeding of the printing inks 11 from the color fountain 10 such that the emerging amount of ink can be individually adjusted zone-wise over the entire printing width. The ink 11 flowing from the ink fountain 10 passes through a ductor 13 and a vibrating roller 14 to a number of distributing rollers 15 which have different diameters and are mounted so as to be partially movable axially in order to divide the ink film repeatedly and spread it uniformly. The printing ink is finally taken over by applicator rollers 16 which are in contact with the printing form 4 and coat the latter with a thin film of ink.

The printing form 4 bears the picture to be printed, in which those parts which are to be printed are able to pick up the printing ink 11 and are simultaneously water-repellent (hydrophobic), while the parts which are not to be printed are able to pick up water (hydrophilic) and do not pick up any printing ink 11. Therefore only the hydrophobic areas of the printing form 4 are coated with ink by the inking unit 2, while the hydrophilic areas remain free of ink.

The ink is then transferred by those parts of printing form 4 which bear the printing ink 11 to the rubber cylinder 5 which engages the plate cylinder 3 with light pressure. Finally the printing ink 4 is transferred from the rubber cylinder 5 to the printing substrate or paper 17 which runs through the gap between the rubber cylinder 5 and the printing cylinder 6. For this purpose the printing cylinder 6 has a gripper system, not shown in detail, which has a plurality of grippers 18 which are distributed at short intervals over the entire width of the printing cylinder 6 and hold the individual sheets of printing substrate during the rotation of the printing cylinder 6.

Figure 2:
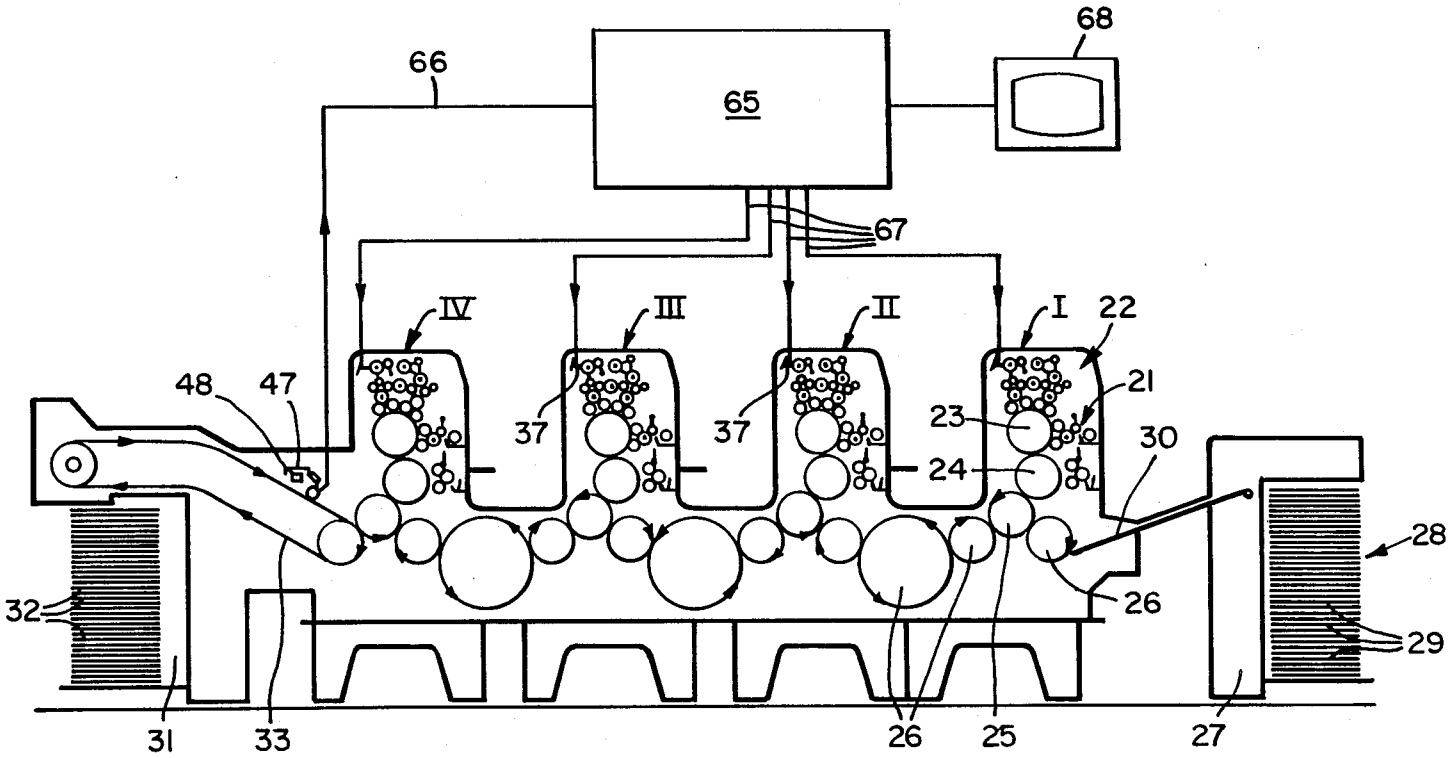
FIG. 2 is the diagrammatic side view of a four-color offset printing press.

FIG. 2 shows the diagram of a four-color offset printing press having four printing units I to IV, unit I being associated, for example, with the color black, while units II to IV print, for example, the colors cyan, magenta and yellow. Each printing unit includes a moistening unit 21, an inking unit 22, a plate cylinder 23, a blanket roll 24 and a printing cylinder 25 corresponding to FIG. 1. In front and in back of the printing cylinder 25 there are a number of transfer cylinders 26. Also, the offset printing press has at its entrance a magazine 27 for a stack 28 of individual, blank sheets 29 of paper and a paper feed 30, while at its exit there is provided a magazine 31 for printed sheets 32.

The operation of such an offset printing press is as follows:

The blank sheets 29 are taken one by one from the stack 28 and aligned precisely on the paper feed 30. Then the sheet 29 that is on the paper feed 30 is picked up by the first transfer cylinder 26 which, like the printing cylinder 25, is equipped with grippers. The sheet 29 is transferred from the first transfer cylinder 26 to the printing cylinder 25, on which the actual printing takes place. During the rotation of the printing cylinder 25, the sheet 29 runs between the printing cylinder 25 and the blanket roll 24 and at the same time picks up the first printing ink, the black ink for example. After it is printed the sheet 29 is fed by means of the next transfer cylinder 26 to the second printing unit II. There the sheet is taken over in precise register by the corresponding printing cylinder 25, so that the pattern of the second color, cyan for example, is printed in precise register. The printing is performed in the printing units III and IV in the same manner. After all four color pictures have been printed on the sheets 29 in four printing units arranged in tandem, they are delivered by a conveyor belt 32 to the magazine 31 and stacked therein. With modern offset printing presses of this kind approximately 6000 to 8000 sheets can be printed in four colors per hour.

Figure 3:
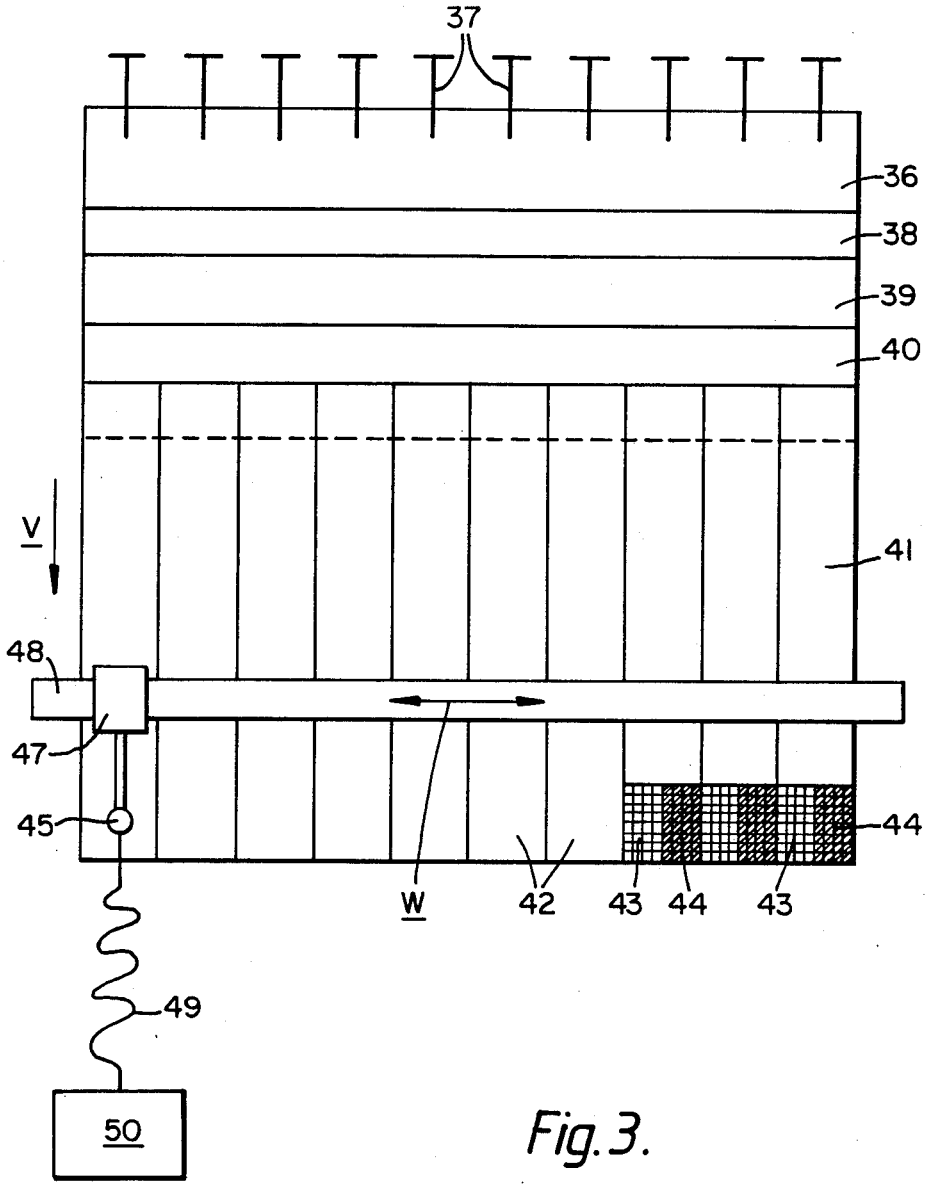
FIG. 3 is a diagrammatic top view of an inking unit of an offset printing press with a printed sheet leaving it.

In the top plan view in FIG. 3 of one printing unit of an offset printing press, only one ink fountain 36 is indicated diagrammatically, with the regulators 37 indicated also in FIG. 1, a plate cylinder 38 bearing the printing form, a blanket roll 39, and a printing cylinder 40, all of which extend over the entire printing width of the machine. A portion of a printed sheet 41 is still lying on the printing cylinder 40. On the basis of the regulators 37, the sheet 41 is printed in a number of imaginary, parallel and contiguous color zones 42 consisting of strips extending in the direction of transport (arrow v) of the sheet and corresponding to the number of regulators. To be able to determine how thick the ink film applied to sheet 41 is measuring patches in the form of screen patches 43 and solid patches 44 are simultaneously printed at the top and bottom margin of the sheet, at least one screen patch and solid patch 43-44 being best provided for each color zone 42, although each screen patch or solid patch could be extended over the width of several color zones 42. The screen patches 43 consist of a plurality of screen dots of equal size having a certain area coverage per unit area of the screen patches. The screen patches 43 are printed by corresponding sections made in the printing form, which are imprinted in preselected steps of, for example, 25%, 50% or 75% area coverage. On the basis of the enlargement or reduction of the screen dots in the screen patches 43 in comparison to the corresponding sections in the printing form, it is therefore possible to conclude how the flow of ink established by any regulator affects the printing and what changes result with respect to the screen dot area coverages in the event of a change in the setting of the corresponding regulator 37. The solid patches 44, on the other hand, consist of areas which are completely covered with printing ink and are formed by corresponding sections in the printing form. The solid patches 44 therefore give especially information as to whether more or less printing ink has been fed by a regulator 37, because in the solid patches 44 only the thickness of the ink film applied can vary.

The screen patches and solid patches 43 and 44 are tested by means of known densitometers, preferably reflected-light densitometers, so as to obtain objective measurements. The densitometers can be manually operated (e.g., Macbeth RD-918) or they can be automatic densitometers (e.g., Macbeth PXD-981) which are manufactured by Kollmorgen-Macbeth and sold by its affiliate Process Measurements Inc., in Newburgh, N.Y. (U.S.A.). When manual densitometers are used, a sheet 29 is taken from the stack of printed sheets at predetermined intervals and examined. If the values obtained in the print differ from those of the original, the pressman can attempt, by acting on the regulators, to bring the measurements back into agreement with those of the original. If an automatic densitometer 45 is used, the latter is then best mounted on a carriage 47 which can be moved back and forth on a track 48 across the width of the sheet 41, in the direction of a double arrow w, by means of controllable motors, e.g., stepping motors. According to FIG. 1, the track 48 can be disposed at any desired point along the path of movement of the sheet 29 between the magazines 27 and 31.

If only one measuring station is desired, the sections producing the measuring patches 43 and 44 are, in accordance with the invention, printed on the printing form such that, after the sheet 29 has been completely printed the corresponding measuring patches of all printing inks are printed one over the other.

In other words, the individual color measuring patches of all of the inks used in printing are overprinted one on the other by means of sections which are provided on the printing forms always at the same locations such that a single combination measuring element of corresponding shape and size is established, which on account of the overprinting contains not only screen dots or a solid surface of a single printing color, but screen dots or overprinted solid areas of all colors, and therefore has a gray shade. As an alternative it is also possible to combine into one combination measuring patch the individual color measuring patches of less than all of the printing inkns used for the print, or, for example, of only two printing inks. According to a preferred embodiment, only the chromatic printing inks (e.g., magenta, cyan and yellow) are used in forming the combination measuring patch, while achromatic inks (e.g., black) are associated with a single-color measuring patch, if one is desired. In the case of other than four-color printing, a similar method can be used. Furthermore it is possible to provide such combination measuring patches not in all color zones, but only in selected color zones, e.g., in every second, third, etc., color zone. In any case, the use of combination measuring patches gives the important advantage that fewer measuring patches are needed within each selected color zone than there are inks, preferably chromatic inks, so that in one row, and within each color zone, there is sufficient room to print measuring patches which supply all of the information needed for the control. If, for example, three single-color measuring patches with the primary colors magenta, cyan and yellow are combined to form a brown or gray combination measuring patch, then only a third of the space is required that would be needed in the case of the side-by-side printing of three single-color measuring patches. If, therefore, two brown or gray combination measuring patches are provided, which can be in the form of screen dot or solid patches, of the width of an available color zone of 30 mm to 40 mm, only about 16 mm is needed for two combination measuring patches each 8 mm wide, so that a number of additional measuring patches or control elements can be contained on the rest of the width for the same or other purposes. Because wherever a combination measuring patch is provided, the corresponding single-color measuring patches can be dispensed with.

If combination measuring patches are used exclusively, the densitometer 45 is disposed, for example, between the printing unit IV and the magazine 31. In this case the densitometer 45 is either provided with a beam splitter by which the incident beam of light is divided into a plurality of light beams which simultaneously pass through several filters and are evaluated separately from one another, or it is provided with a number of filters, especially complementary filters in tandem, through which the light beams pass successively. Other arrangements are conceivable, so long as it is possible to obtain from each combination measuring patch information on all of the printing inks involved. Aside from this, in case of necessity appropriate measures, known in themselves, can be provided for synchronization in order thereby to specify precisely the moments in time at which the densitometer will perform a measurement.

Alternatively, additional measuring stations can be provided between the individual printing units I to IV, and the measuring patches of the individual printing inks can be so arranged that, after the printing, they will be side by side and therefore, to improve the accuracy, each printing ink is associated with a separate measuring patch and a separate densitometer. Also, the densitometer 45 is best connected by a flexible cable 49 to an automatic evaluating station, a electronic data processor 50, or the like.

The same procedure can be undertaken when a rotary web offset printing press is used. Alternatively, a single sheet taken from the machine can be scanned manually or by means of a densitometer automatically carried across the sheet.

Figure 4:
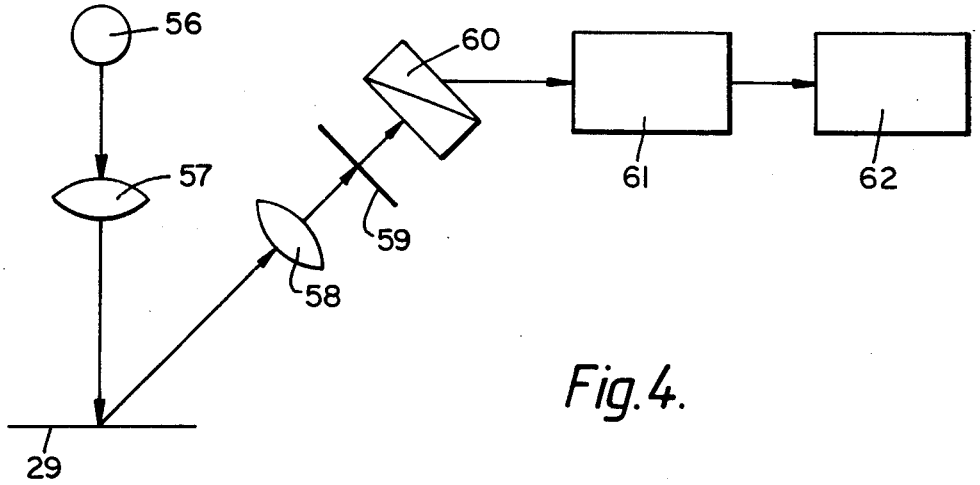
FIG. 4 is a schematic diagram of a densitometer.

The manner of the operation of the densitometer 45 is diagrammatically represented in FIG. 4. Light beams from a light source 56 are focused by means of a lens 57 onto the sheet 29, e.g., onto a screen patch or solid patch 43 or 44 of a particular printing ink. A portion of the incident light beams is thus absorbed, while the remainder is reflected and focused by a lens 58 onto a color filter 59. This color filter 59 has a color (cyan-red, magenta-green, yellow-blue) complementary to the color being measured, whereby the chromatic light beams are converted to achromatic or gray light beams. After the color filter the light beams reach a receiver 60, which consists of an opto-electronic converter and converts the light beams to electrical signals. These signals are then delivered to an evaluating circuit 61 and processed in the latter. The results of the measurement can be displayed digitally on a viewscreen 62. The color filter 59 can be disposed together with other color filters within a rocking or turning means such that a color filter associated with the printing color being observed can be turned into the light beams so as also to make manual testing also possible in a simple manner.

The densitometer 45 measures the optical density D, i.e., the decadic logarithm of the reciprocal of the reflectance, which is the quotient of the reflected light flux and the incident light flux. If the optical density is read on a screen patch, the screen density $D_R$ is obtained, while the density read on a solid patch is referred to as the solid density $D_V$. $D_R$ and $D_V$ can be used in a known manner (Murray-Davies, Jule-Nielson) to compute the so-called optically active area coverage of the screen dots, which is slightly greater than the so-called mechanical area coverage which is obtained by studying the screen dots with a microscope or the like. For the purposes of the invention, however, it is important that the screen density, like the optically active or the mechanical area coverage is ultimately only a magnitude which indicates the size of the screen dots. The same applies to the concept of screen dot variation, which gives information as to the extent to which screen dots are enlarged or reduced during printing. In the following description and also in the claims, therefore, these four terms are comprised in the term, "screen dot size." Otherwise, the screen patches can be provided in various halftone steps of, for example, 25%, 50% and 75% of their optically active or mechanical area coverage. The sequence and frequency of the measurements depends mainly on the specific properties of the multicolor offset press used and on the variations in the print occurring over the short term or the long term. Aside from this, densitometers that are operated manually are used mainly in the preparatory phase for the purpose of obtaining, on the basis of a sample or test print, the data that will be needed in the subsequent production run, while fully automatic densitometers are used mainly in the production run.

The control apparatus according to the invention (FIG. 2) includes, in addition to a system for measuring actual values in the form of the densitometer 45 (or several densitometers), a regulator system consisting of the sum of all regulators 37. The part of the press that is controlled by the regulators is the path traveled by the ink from the ink fountain to the paper. The heart of the control apparatus is a computer 65 to which the information obtained by the densitometer 45 is fed through a line 66 and which sends the actuating signals to the regulators 37 through lines 67. Also, the computer 65 can be provided with a display 68 on which the data can be made visible. The computer can furthermore be controlled by previously created programs and can then compute a recommendation for the actuation of the regulators 37, which can either first be displayed on the viewscreen 68 and then released on a command by the pressman or, in the case of fully automatic operation, can be immediately fed to the regulators 37.

An embodiment of the controlling process according to the invention will now be displayed, based on the assumption that all of the measuring patches consist of individual color measuring patches.

For each chromatic printing color, e.g., cyan, magenta and yellow, screen patches 43 (FIG. 3) are printed with the picture, and they are associated with one or more color zones 42. At the beginning of a print, a guidance value in the form of a screen density or a mechanical or optically active dot area coverage is associated with each screen patch 43 and defines the desired screen dot size in that particular screen patch 43. If, as usual, the area coverage of the screen dots in the associated section of the printing form that produces the screen patch 43 is known, the screen dot size in the screen patches 43 can also be defined by the screen dot enlargement or screen dot reduction with reference to the screen dot size on the corresponding section of the printing form. A maximum and/or minimum value of the screen dot size is furthermore associated with each screen patch 43, thus providing a screen dot size tolerance range. Moreover, selected equations between the screen patches of two or even more printing colors can be defined, e.g., the differences or quotients of the screen dot sizes in relation to the color pairs cyan/magenta, cyan/yellow and magenta/yellow; as a rule only the selected equations for two pairs of colors are needed, because the corresponding equations of the third color pair automatically follow. Here, as in the case of the other factors, the selection depends on whether the screen densities, the mechanical or the optically active area coverages or the screen dot variations are used to define the screen dot size, according to the characteristics of the densitometers or other measuring devices, of the computer, of the computer program, of the multicolor-offset printing press used in the particular case, or the like. Then, for the selected equations, maximum and minimum values determining other tolerance ranges are established. Then provision can be made for the tolerance ranges of the screen dot size to remain constant throughout the printing. But it is also possible to design the computer program to make the computer repeatedly recompute the tolerance ranges during the print on the basis of input values, e.g., on the basis of varying correlations between the ink film thickness and the screen dot area coverage.

In like manner, solid patches 44 (FIG. 3) of each chromatic printing color (or also of black) can be printed together with the picture, and can be associated with one or more color zones 42. For these solid patches, guidance values, maximum and minimum values defining tolerance ranges and, if necessary, selected equations with corresponding tolerance ranges can be established or repeatedly computed via the computer program.

If in addition to the screen dot sizes the solid densities are included in the computer program, the computer is also informed of correlations between the screen dot sizes and the ink film thicknesses, the ink film thicknesses being best input in the form of the corresponding solid densities, since these are representative of the ink film thicknesses. Such a correlation can mean, for example, that a raising or lowering of the solid densities in the range of $D_V=1.20$ to $D_V=1.40$ by $\Delta D_V=0.10$ corresponds to an increase or reduction of the screen density by $\Delta D_R=0.03$. Here, again, the correlation between ink film thickness or solid density on the one hand and screen dot variation or screen dot density on the other can be defined by other magnitudes, e.g., the solid densities and the corresponding screen dot variations expressed as percentages. For different printing colors and different ranges of the solid densities different correlations can exist. Furthermore, the computer can be instructed by its program to recompute repeatedly the correlations that are variable during the printing and to use always the momentary correlations in computing its recommendations for the operation of the regulators 37.

Lastly, selected priorities which are to be used in computing the plans for the operation of the regulators 37 can be put into the computer. These priorities can require, for example, that (1) the screen dot sizes and/or solid densities must be within the tolerances associated with them, (2) the selected equations between the screen dot sizes and/or solid densities of the different printing colors must be within the tolerances established for them, and (3) the absolute screen dot sizes and solid densities must be as close as possible to the established guidance values. At the same time the priorities must be established such that the computer will be able in each case to make a definite decision. Alternatively, a priority might consist in informing the computer of certain dominances expressing, for example, that, in the computation of an adjustment recommendation, it must begin with the color in which the greatest differences have been encountered during the printing, or which is most strongly represented in the color zone in question, considered as a whole.

An example of the computing that can be performed for the control of a four-color offset printing press of 32 regulators per inking unit is given below. The example relates to only one color zone, e.g., color zone No. 24, and to the corresponding regulators No. 24 of the inking units printing this color zone. Under consideration are the cyan, magenta and yellow printing inks. The printing forms for these ink colors have, in the corresponding color zone, a content of 60% cyan printing locations and a content of 50% locations each for magenta and yellow. Furthermore, the printing forms have in this color zone at least one screen patch and one solid patch, 43 and 44. For measuring the density, the PX-981 Densitometer made by the Macbeth company is used, which measures the measuring patches with the press running. The computer is given the following data for color zone No. 24:

(a) Cyan:

$D_R$ (guidance value)=0.55, tolerance±0.05

$D_V$ (guidance value)=1.30, tolerance±0.10

(b) Magenta:

$D_R$ (guidance value)=0.45, tolerance±0.05

$D_V$ (guidance value)=1.30, tolerance±0.10

(c) Yellow:

$D_R$ (guidance value)=0.45, tolerance±0.05

$D_V$ (guidance value)=1.30, tolerance±0.10

(d) Selected equations:

$D_R$ (cyan)−$D_R$ (magenta) (guidance value)=+0.10

Tolerance +0.08 to +0.12

$D_R$ (cyan)−$D_R$ (yellow) (guidance value)=0.10

Tolerance −0.08 to +0.12

$D_R$ (magenta)−$D_R$ (yellow) (guidance value)=0.00

Tolerance −0.02 to +0.02

(e) Correlation between solid densities and screen densities: a change of the three solid densities in the range from $D_V$=1.20 to $D_V$=1.40 amounting to $\Delta D_V$=0.10 results in a screen density change of $\Delta D_R$=0.03.

(f) Priorities:

1. The tolerances specified for the screen and solid densities are not to be exceeded. If the measurement yields values that exceed the tolerances, a plan is to be computed so as to actuate the regulators No. 24 such that the values will be returned to within the tolerances and so as to fulfill insofar as possible the conditions specified in priorities 2 and 3.

2. The tolerances specified for the select relationships according to d are not to be exceeded. If the measurement yields values that exceed the tolerances, a plan is to be computed so as to actuate the regulators No. 24 so that the values will be returned to within the tolerances. At the same time the computation can start with the ink which in regard to magnitude $D_R$ is farthest away from its guide number. The computed plan must fulfill the conditions according to priority 1 and should fulfill the conditions according to priority 3.

3. If the conditions 1 and 2 are fulfilled, but the plans still leave alternatives open, first the screen density guidance values and then the solid density guidance values are to be achieved as well as possible.

4. If the computer finds no way of controlling so as to fulfill conditions 1 and 2, an error signal is given to this effect.

Measurements in color zone No. 24 then give, for example, the following results during the production run:

| | | | |
|---|---|---|---|
| (A) | Cyan | $D_V$ = 1.32 | $D_R$ = 0.57 |
| | Magenta | $D_V$ = 1.30 | $D_R$ = 0.50 |
| | Yellow | $D_V$ = 1.28 | $D_R$ = 0.47 |

The condition of priority 1 is fulfilled for all colors.

| | | |
|---|---|---|
| (B) | $D_R$ (cyan) − $D_R$ (magenta) = 0.07, | out of tolerance |
| | $D_R$ (cyan) − $D_R$ (yellow) = 0.10, | within tolerance |
| | $D_R$ (magenta) − $D_R$ (yellow) = 0.03, | out of tolerance |

The condition of priority 2 is not met in the case of two differences.

The print color for which the screen density is farthest away from the guidance value is magenta at $\Delta D_R$=0.05. Therefore an attempt is first made to bring the screen density of magenta back to the value 0.45. On account of the correlation, this would mean that the solid density would decrease by about 0.167 to $D_V$=1.133, so that the condition of priority 1 would not be satisfied. Even if the magenta screen density were to decrease to 0.46, with $D_V$=1.167 the condition of priority 1 would not be satisfied. If, however, the magenta screen density is reduced from 0.50 to only 0.47, the condition of priority 1, with $D_V$=1.20, is satisfied for magenta. The conditions according to priority 1 can accordingly be satisfied also by reducing the magenta screen density to 0.48 and 0.49. But since priority 3 prescribes that, if there are several possible alternatives, first the screen density is to be brought as close as possible to the corresponding guidance value, the value of $D_R$=0.47 is the best value that can be reached according to the above control program. It is then to be expected that the screen density differences will assume the following values as the run continues:

| | |
|---|---|
| $D_R$ (cyan) − $D_R$ (magenta) = | +0.10 |
| $D_R$ (cyan) − $D_R$ (yellow) = | +0.10 |
| $D_R$ (magenta) − $D_R$ (yellow) = | 0.00. |

The conditions according to priority 2 are all satisfied. Consequently, the computer, after running through all the alternatives, recommends reducing the magenta screen density from 0.50 to 0.47. In the case of off-line operation, this proposal is interpreted by the pressman, on the basis of a table, as a corresponding change of the regulator 37 for color zone No. 24 and the magenta printing inks. The amount by which the regulator has to be adjusted depends on the particular printing press, i.e., it is necessary always first to determine what correlation exists between a change in the setting of the regulators and the change in the ink film thickness or solid density that is achieved thereby. In on-line operation, the pressman gives his approval simply by pressing a key, whereupon the corresponding regulator is adjusted automatically by means of a stepping motor or servo motor or the like.

If, in a variant of the above example, a solid density of $D_V$=1.24 has been measured instead of $D_V$=1.30, then, if the magenta screen density is reduced to values between 0.45 and 0.48, solid densities would result which do not satisfy the conditions of priority 1. Not until $D_R$ is reduced to 0.49 does the solid density, at $D_V$=1.207, lie within the required tolerance range, so that the computer would recommend a reduction of the screen density of magenta to 0.49, which, when the regulating action is completed, gives the following differences between the screen densities:

| | |
|---|---|
| $D_R$ (cyan) − $D_R$ (magenta) = | 0.08 |
| $D_R$ (cyan) − $D_R$ (yellow) = | 0.10 |

-continued

| |
|---|
| $D_R$ (magenta) − $D_R$ (yellow) = 0.02. |

These values are all within the tolerances according to priority 2.

The above examples show the superiority of the control strategy according to the invention in comparison with conventional control methods. In the example, it was assumed that the screen densities important to sustaining the color balance had all changed. The change in the case of magenta was relatively great, and, if conventional control apparatus had been used, it would have had to be outside of a narrow tolerance range. As a result of the failure of the magenta screen density to be within the tolerance range, the computer would have proposed to change the screen density of magenta to 0.45 or a value close to it. Then, if only the screen density is used as the controlling magnitude, it would not be noticed that the recommended adjustment simultaneously brings about an unacceptable change in the solid density. The result would be the same if only the solid density is adjusted, since an increase of the solid density for yellow from 1.28 to the guidance value of 1.30 would have resulted simultaneously in a change of the corresponding screen density from 0.48 to 0.53, and in an unobserved departure from the corresponding tolerance range. If, however, both the solid densities and the screen densities are used as controlling factors, the computer would have been unable to make a reasonable recommendation for adjustment. If the control strategy according to the invention is employed, however, it is possible (a) to establish relatively broad tolerances for the absolute values of the solid densities and screen densities, yet (b) to maintain the color balance by relatively close tolerances for the selected equations, and (c) to work out rational adjustment recommendations taking the correlation into consideration. The "selected equations" serve the purpose of tolerating those changes in the screen densities and/or the solid densities of the printing colors involved in relation to one another which run essentially in the same direction, but largely to exclude changes on opposite directions. The arithmetical average of the screen dot sizes and/or solid densities of all chromatic and/or achromatic printing colors will be mentioned only as an example of selected equations. Instead of the differences and quotients, other equations might be selected, and extended to the equations among three or more printing colors. The proposed differences and quotients for color pairs, however, have the advantage that they can easily be achieved by electrical circuits, on the one hand, and therefore can be computed also automatically with inexpensive circuitry, while on the other hand, changes within narrow tolerances of the differences and quotients of the screen densities in the corresponding color cube produce only changes close to the diagonals of the color cube and thus mainly changes in the brightness of a printed color, but hardly any change in the color shade. The correlation, however, in contrast to former control methods and apparatus, permits not only a comparison of the absolute values of the screen and solid densities, but also an estimate of the changes which are actually achieved by an intervention in the printing process with the regulators 37, both in regard to the solid density and in regard to the screen density. With constant recomputation over the long term, the correlation serves for the automatic adaptation of the control strategy to the changing characteristics of the printing press.

Figure 5:
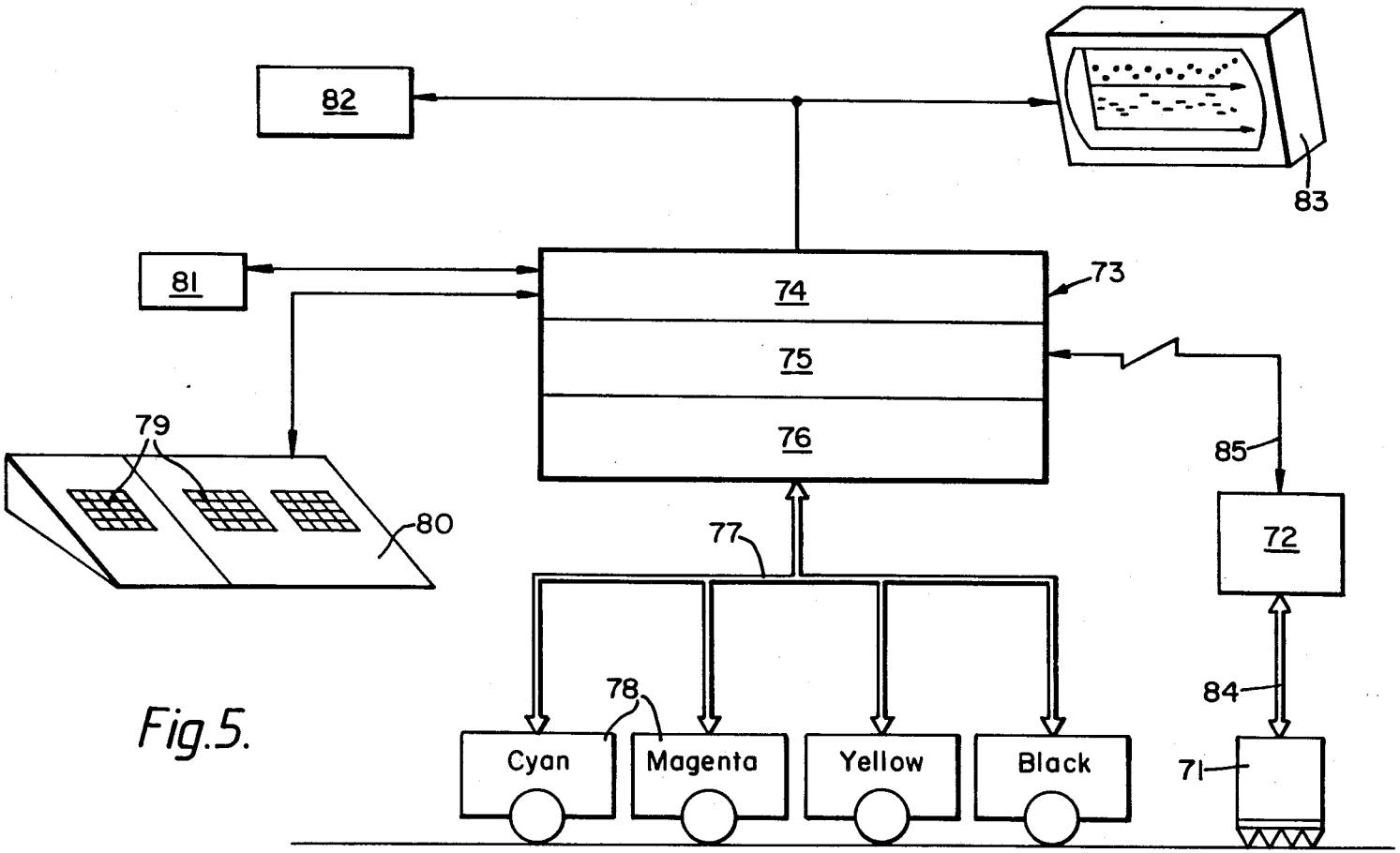
FIG. 5 is a schematic diagram of a control apparatus according to the invention.
Figure 7:
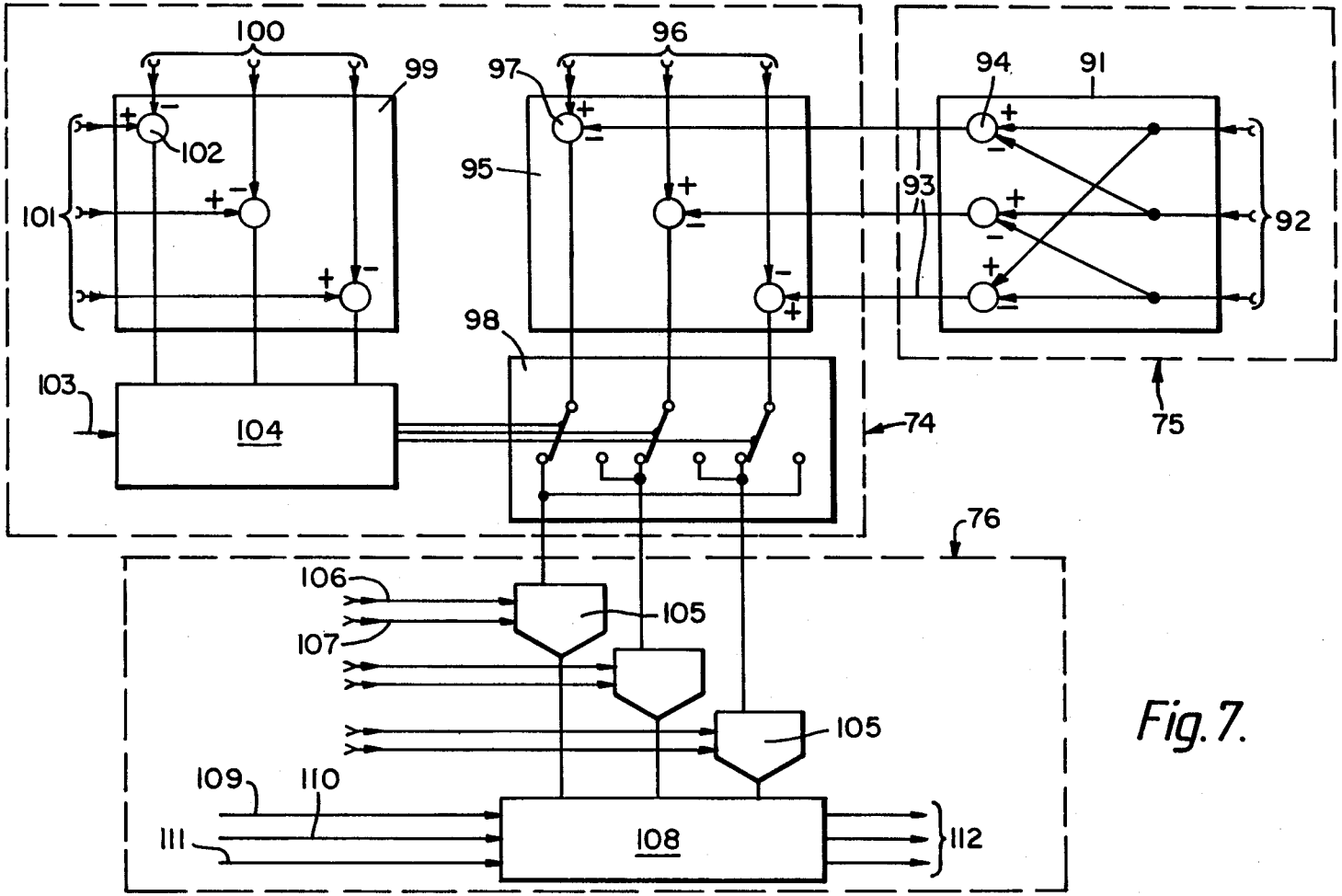
FIG. 7 is a schematic diagram showing the operation of the control apparatus of FIG. 5, FIGS. 8 and 9 show two embodiments of the set of single-color strips according to the invention.

Details concerning the automatic control unit system will now be further explained in conjunction with FIGS. 5 to 7. The control system includes first a densitometer 71, e.g., a Macbeth PXD-981, which senses a printed sheet and feeds the data obtained from it to a measurement data logger 72 which then transfers the data to an automatic control unit system 73. This consists essentially of a reference value and guidance value computer unit 74, an actual value/measured value computer unit 75, and a process control computer 76, which is connected by lines 77 to the regulators of ink fountains 78 of a multicolor offset printing press. The guidance value computer unit 74 is connected with a number of peripheral units, e.g., an operating console 80 having key pads 79, a memory 81 in the form of a magnetic tape unit, bubble memory, tape punch, or the like, a printing unit 82 and a monitor 83, in the form, for example, of a cathode-ray tube.

The operating console 80 serves for the entry of commands, especially those concerning the various guidance values, tolerances or the like, into the automatic control unit system 73. In the memory 81 are stored, for example, all the data relating to a particular edition which have already produced a good print and which especially contain all the necessary adjustments for the ink fountain 78. The printing unit 82 can print out the data appearing on the monitor 83 or a record of the printing process during a printing run. The monitor 83 serves to display the current states of operation of the multicolor offset printing press, recommendations computed by the automatic control unit system for the operation of regulators, or the like. The guidance value computer unit 74 processes the data and commands received from the operating console 80 and from the memory 81, works up recommendations, and, after displaying them at the monitor 83 if desired, and after the pressman has approved them, feeds them to the process control computer 76. The latter then converts these data to electrical signals whereby the regulators of the control system, which consists of the ink fountains and their keys or ducts, or the motors that control them, are operated in the desired manner. The measurement data logger 72 is connected by a flexible cable to the densitometer or densitometers 71 and, via a plurality of parallel lines 84, picks up in rapid succession all of the data obtained by them. In order that these data will not have to be fed through a corresponding multiplicity of lines to the automatic control unit system 73, which is usually remote from the multicolor offset printing press, the measurement data logger 72 is situated directly at the press, so as to be able to concentrate the data received and then transfer it serially through a few conductors 85 to the automatic control unit system 73.

The densitometer 71 is guided over the printed paper according to a program which is fed to it through the guidance value computing unit 74 and the measurement data logger 72. The program contains, for example, data for the motor by which the densitometer 71 is driven across the paper, as well as data concerning the times at which it is to output measuring data and, for example, throws a spot of light onto the paper for that purpose. Provision can be made for the densitometer 71 to move gradually from one color zone 42 to another (FIG. 3) and, after reaching a color zone, it can be actuated to output measuring data whenever a screen patch or solid patch 43 or 44 or any other measuring patch of a printed paper moves past it. Densitometers are used, for example, which, upon the emission of a flash of light, immediately break up the reflected light beam by means of a prism, optical filters or the like, into the partial beams associated with the printed colors present, so that measuring data are obtained from each flash of light for all of the printed colors. As indicated in FIG. 6, all of the data relating to a printing run can be entered into the guidance value computing unit 74 from the memory 81 and the operating console 80. These data are labeled "solid densities," "screen dot sizes," "selected equations" (meaning the guidance values for each), "tolerances s.d., d.s. and s.e." for the solid densities, the screen densities and the selected equations, "correlations," "priorities," "ink consumption," "color balance," "print type correction," and "color type correction."

Thus, for the data explained above, first data relating to ink consumption can be entered. This includes the total percentage of consumed ink determined within a color zone, which can vary between 0% and 100% for each ink. The sensitivity or response time of the controlling operation can be governed on the basis of the ink consumption. If the ink consumption is high in a color zone, the operation of a regulator will more rapidly affect the printing result than when it is low. If there is a given difference between an actual value or a measured value and the desired guidance value or reference value, it can therefore be desirable in the case of low ink consumption to actuate the corresponding regulator more strongly at first than would be necessary in the case of high ink consumption, in order thereby to obtain a more rapid approach to the guidance value. Aside from that, a adjustment of the regulators can also be made dependent upon whether the printing ink is applied more or less intensely, i.e., in a greater or lesser film thickness. Through the "ink consumption" memory unit it is thus possible to enter a correction value for the actuating signal delivered to the regulator in question.

Further corrections of the actuating signals may prove necessary whenever extreme differences in ink consumption and/or inking intensity exist, so as to avoid visible changes in these transitions in the operation of the regulators. Lastly, the factors "print type correction" and "color type correction" are intended to produce correction values for the reference signals which are necessary on the basis of the properties of the paper or inks that are used. Consideration must especially be given to whether the papers can absorb more or less printing ink, or whether the printing inks are applied more or less strongly to the paper under otherwise equal conditions, on account of their rheology. The actual value computer unit 75 contains an actual value memory 87, especially one having memory units for the screen densities and solid densities measured by the densitometers 71. In addition, memory units can be provided into which are entered data relating to the "optically active area coverage," the "mechanical area coverage," the "screen dot changes" and the "ink film thickness." Finally, memory units can be provided in which information can be stored relating to the measuring programs, screen area parameters 43 (e.g., their surface coverages in percent) or the like. These data are repeatedly determined by the actual value computer 75 on the basis of the screen densities and solid densities.

The process control computer 76 serves to compare the data computed and output by the actual value computer 75, constantly or at certain intervals of time, with the guidance values or tolerances given by the guidance value computer 74, to compute actuating signals for regulators 88 on the basis of the priorities or control strategies received from the guidance value computer 74 and to display them, if desired, on the monitor 83, or directly feed them to the regulators 88 which consist of the keys, their drive motors, or the like, each ink fountain of the multicolor offset printing press being able to have, for example, 32 such regulators. The process control computer has for this purpose an adjustment value memory 89 containing memory units for the data delivered by the guidance value computer 74. These data relate, for example, to the start-up states of the ink ductors or regulators in relation to the ink consumption or they are data obtained from previous identical or similar press runs, compensation factors (e.g., in the case of a color zone being affected by an adjacent color zone, calculated on the basis of the ink consumption), plus characterizations of the color ductor apertures or the like, with the aid of characteristic curves (e.g., with the aid of the ratio, Δaperture:Δink mass flow), or, lastly, actual control strategies computed on the basis of the priorities or color dominances.

Lastly, details of the process control system are represented in FIG. 7. Accordingly, the actual value computer unit 75 contains for each color zone one computer unit 91 whose inputs 92 receive the data on the measurement of the screen densities of the printed colors. These data are converted to appropriate signals corresponding to the actual values, which appear in lines 93. Similar computer units 91 can be provided for the area coverages. The computer units 91 for the "selected equations" or relationships between the screen dot sizes also have difference circuits, dividing circuits or other circuits 94 for the purpose of forming the differences, quotients or the like of two or more measured values.

The guidance value computer 74 contains, for each color zone, computer units 95 to whose inputs 96 are fed the guidance values or the limit values of the tolerances for the screen dot size, and which have circuits 97 which compute the differences between the guidance values and actual values or only determine whether the actual values are within or outside of the corresponding tolerances. The data obtained are delivered to a microprocessor 98 composed of programmable matrices by which the strategies for the process control computer 76 are computed with the aid of the correlations and priorities.

Similarly constructed computer units 99 can be provided for the solid densities, and the measured and similarly converted actual values can be fed to their inputs 100, for example, and the guidance values of the tolerances can be fed to their other inputs 101. The computer unit 99 has circuits 102 which compute the differences between the guidance values and the actual values, or which merely determine whether the solid densities are within the tolerances. The corresponding data are also fed to the microprocessor 98. Finally, the information contained in the "priorities" memory units (FIG. 6) are fed to the microprocessor 98 through a line 103. In the example of FIG. 7, provision is made for this by inserting into the connecting line between the computer unit 99 and the microprocessor 98 a comparator 104 connected also with line 103; this comparator establishes as a priority that the microprocessor 98 is first to begin with the processing of the data on the print color whose solid density most greatly departs from the corresponding reference or guidance value.

In the microprocessor 98 the obtained data are processed in accordance with the program described above or any other given program stored, for example, in memory 81 (FIG. 5). Then a recommendation is computed as to how the regulators would have to be set in order to satisfy all priorities. This recommendation is displayed, if necessary, at the monitor 83 and evaluated by the pressman. If necessary, corrections can be performed at the operating console 80. Finally, the data computed by the microprocessor 98 are converted into actuating signals for the regulators, either directly (in the case of fully automatic operation) or after release and correction, if necessary, by the pressman, and then delivered to nonlinear controllers 105, one controller 105 being associated with each regulator. The controllers 105 produce a certain adjustment of the regulators on the basis of the control signals. At the same time, the data for the correction of the print type and color type values stored in the corresponding memories of the reference value computer 74 (FIG. 6) can be fed to additional inputs of the controllers 105, e.g., through lines 106 and 107. To the outputs of the controllers 105 there is connected an additional correction circuit 108 to which-the data from the ink consumption memory (FIG. 6) are fed through line 109, and the data from the color equalization memories with reference to the two adjacent color zones are fed through lines 110 and 111. The output lines 112 of the correction circuit 108 lead to the regulators. Consideration must be given to the fact that the correction circuit 108 and the controllers 105 are associated with one of the 32 color zones and three printing colors, e.g., cyan, magenta and yellow, and corresponding correction circuits and controllers must be present for the rest of the color zones.

The invention is not restricted to the embodiments described, but can be modified in many different ways. This is especially true of the various circuits of the control apparatus. In regard to the given tolerances, it should be noted that they should be made as narrow as possible, such that when a measurement is outside of its tolerance the printing result is still within the limits tolerated by the pressman or by the customer, and that even slight losses of quality which might occur before the control system becomes fully effective do not cause the prints made in the meantime to become unusable. In particular, additional limits could be entered into the automatic control unit system which are outside of the tolerances and the automatic control unit system could be instructed to interrupt the printing when these limits are reached or exceeded.

The number and frequency of the measurements made by the densitometers are largely left to the discretion of the technician. To increase the accuracy of measurement in each color zone, it is recommendable to perform in each color zone several measurements at first, with regard to both the solid densities and the screen densities, for instance by measuring five sheets passing through successively, and forming an average of the readings thus obtained. This will require a period of several seconds, within which the characteristics of a multicolor offset printing press do not, as a rule, change. From the averages thus obtained, recommendations for the adjustment of the color zone in question are computed. At the end of these measurements the densitometer is set to the next color zone, where the same measurements are repeated on the next sheets passing through. By moving the densitometer back and forth constantly, but in steps or cycles, over the entire printing width, data on the printing run will thus be constantly computed and adjustment recommendations will be computed if necessary. At the same time an additional memory of the reference value computing unit can be instructed as to the length of time, measured, for example, by the number of sheets passing through, after which a particular command for an adjustment has to be converted to the desired alteration of the corresponding parameter. Lastly, with the aid of the given adjustment commands and of the changes actually made in the regulators or of the changes thereby caused in the ink film thicknesses or screen densities, the correlations existing among them can constantly be recomputed in order thereby to be able to detect system changes during the run and to use the last-measured correlations as a basis for the control recommendations.

Figure 8:
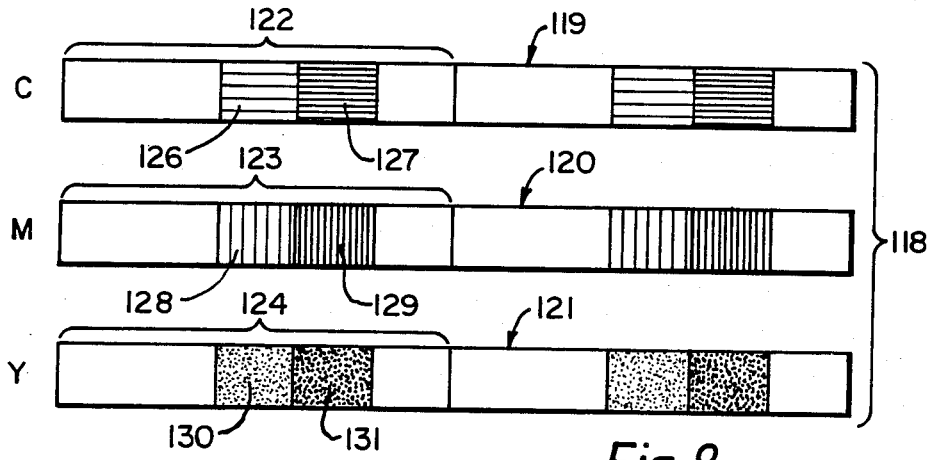

FIG. 8 shows an embodiment of a set of single-color strips 118 according to the invention, which consists of three single-color strips 119, 120 and 121. The set and each single-color strip 119 to 121 contains, in a row one next to the other, preferably as many zones 122, 123 and 124 as there are color zones in the multicolor offset printing press being used. The upper single-color strip 119 is associated with the color cyan, the middle single-color strip 120 with the color magenta, and the bottom single-color strip 121 with the color yellow. The single-color strips are, for example, positive films which in a known manner are transferred to a location provided for them on the corresponding printing form such that they are printed successively by the individual printing units each at the same location on the upper or lower margin-of the picture where they form the so-called print control strip.

The single-color strip 119 contains in zone 122 one screen element 126 and one solid element 127, so that corresponding measuring patches appear at the corresponding location on the paper. The number and shape of the screen dots can best correspond to a preselected pattern. In offset presses today, a screen with a fineness of 54 or 60 is used, depending on the type. However, since it is possible on the basis of the border zone theory to convert mathematically the values obtained with screens of a fineness of 60 to those which would be produced by one with a fineness of 54 (and vice versa), the same set of single-color strips can be used for both screen grades. Other screen grades are also conceivable, since the mathematical conversion is possible at least for finenesses differing by about 10% to 15% from the screen fineness used in the printing. The size of the screen dots, however, are preselected on the basis of a preselected gray value such that those screen dots of single-color strip 119 which carry areas to be printed on the printing form have, for example, an area coverage of 50%. The solid element 127 is formed such that it will result in a correspondingly large area having a defined solid density.

The single-color strips 120 and 121 have respectively one screen element 128 and 130 within the zones 123 and 124, respectively, and each has a solid element 129 and 131, respectively. The shape and number of the screen dots in the screen elements 128 and 130 again correspond to the selected screen fineness, while the size of the screen dots in these screen elements results, for example, in area coverages of 41% each. The solid elements 129 and 131 are selected such that they result in areas having a defined solid density.

The screen elements 126, 128 and 130 are each disposed in a portion of zones 122, 123 and 124 such that the corresponding sections of the printing forms print at the same location on the paper. Thus there appears on the paper, instead of a set of three screen patches of one color per color zone, only a single, gray or brown screen patch with a gray value which is composed of the halftone steps 50% cyan, 41% magenta and 41% yellow. In like manner, the three solid elements 127, 129 and 131 are printed one over the other on the paper, so that the result is again a single measuring patch in gray or brown.

The areas 122, 123 and 124 represented in FIG. 8 in the right-hand portion of the set of single-color strips are made in like manner. Furthermore, only two out of 28 zones, for example, are indicated.

Figure 9:
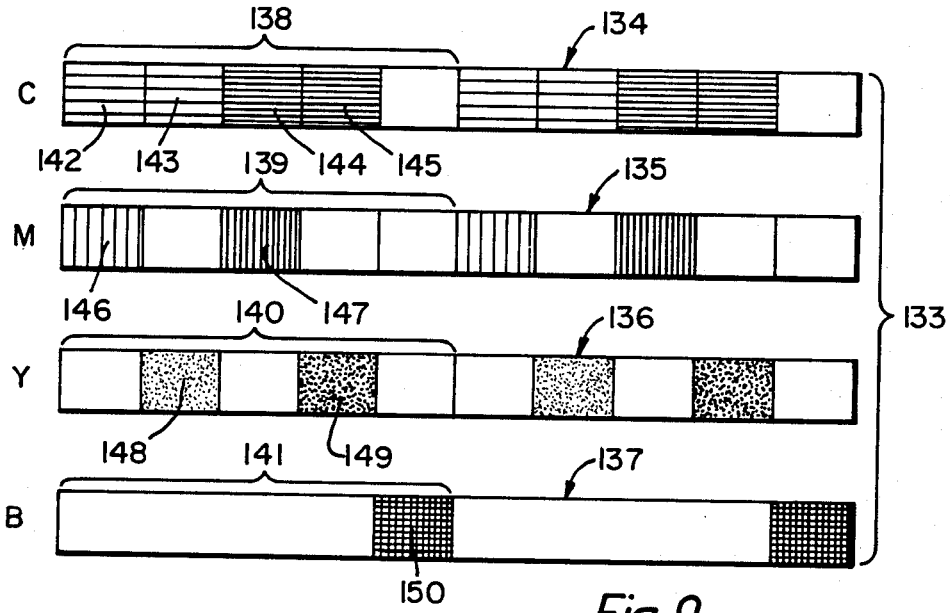

While in the case of the set in FIG. 8, only two measuring elements are represented in each zone, FIG. 9 shows a set 133 of four single-color strips 134 to 137 which are associated with the colors cyan, magenta, yellow and black. The set, or each individual color strip, again has a length corresponding to the width of the color zones of the printing press, and a correspondingly long zone 138 to 141 for each color zone. In contrast to FIG. 8, zone 138 of the single-color strip 134 has two screen elements 142 and 143 and two solid elements 144 and 145. The single-color strip 135 contains one screen element 146 at the location corresponding to the screen element 142 and one solid element 147. The single-color strip 136 contains one screen element 148 at the location of the screen element 143 and, at the location of the solid element 145, a solid element 149. Lastly, the single-color strip 137 contains a screen element 150 in zone 141. The arrangement is made such that, after the transfer of single-color strips 134 to 137 to the associated sections of the printing form, and during the printing the screen elements 142 and 146, further the screen elements 143 and 148, and solid elements 144 and 147, and lastly solid elements 145 and 149, are in each case overprinted one on the other, while the screen element 150 is not printed over any other measuring element. Thus measuring patches are obtained on the paper which contain combined screen information on the colors cyan/magenta and cyan/yellow, and combined solid color information on the colors cyan/-magenta and cyan/yellow. Furthermore, a measuring patch is obtained which has information only on the color black.

The examples that have been given can be modified in many ways. It is sufficient to save, in those selected color zones in which information is to be maintained on particular colors, the amount of space needed for the printing of other measuring or control elements, by overprinting at least two measuring elements of the single-color strips. Nor is it necessary to associate with each color zone a corresponding zone on the set of single-color strips. Instead, it is also possible to examine two or more adjacent color zones with one common zone of the set of single-color strips. Additional screen patches and solid patches which are not overprinted with any other screen or solid patch, and which are best distributed over the entire length of the single-color strips, serve for the continuous determination of measurement data from which the correlations between the screen dot sizes and solid densities are computed. These data are preferably first collected and then evaluated statistically to obtain an average. The computer programs for this purpose are generally known.

If the measurements are performed on combination measuring patches, the solid densities and/or screen dot sizes and/or selected equations often differ from the corresponding data obtained by means of single-color measuring patches, and this can be attributed to a variety of causes. Surprisingly, however, it has been found that the differences observed are not only substantially smaller when, instead of the absolute solid densities and screen dot sizes, only the selected equations between them, especially differences, are determined, but also that they can be made negligibly small by means of simple and approximative corrections of the measurement data obtained. This is especially true when the differences of the selected equations vary only within the relatively narrow ranges of tolerance given above by way of example, while the printing is in progress. It is basically sufficient, therefore, to subject the data obtained by scanning combination measuring patches to subsequent correction.

To produce the desired accuracy in the correction, it is necessary to have means available for bringing the measurement data obtained at combination measuring patches into agreement with those data obtained at single-color measuring patches. Such a means consists, for example, in a set of mathematical approximation formulas for the correction of the measurement data.

Another means consists, for example, in a color chart or color table which enables corrected data to be obtained by comparison. Let it be assumed that the combination measuring patch is a screen patch and is formed from the combination of the half-tone steps, 50% cyan, 41% magenta and 41% yellow, while the percentages are to relate to the positive screen films of the set of single-color strips, which are transferred photographically onto the printing forms (printing plates) when the latter are made, and may be subject to change during such transfer, but which change is measurable in a known manner.

During the printing run, e.g., the production run, color and shade variations develop which are to be kept within the desired limits by the control strategy described. The causes of these variations are mainly changes in the size of the screen dots of the individual printing colors, these being mainly fluctuations of about ±10% of the particular half-tone steps.

Now, according to the invention, a precise color chart is prepared which includes a color patch developed from the above-cited half-tone steps, 50% cyan, 41% magenta and 41% yellow forming the neutral point of the printing run, and also a plurality of additional color patches developed from half-tone step combinations in the neighborhood of the neutral point, e.g., the combinations 50% cyan, 41% magenta, 39% yellow, or 50% cyan, 39% magenta, 41% yellow, or 48% cyan, 41% magenta, 41% yellow, etc., which here corresponds to various gray shades. This color chart is printed under the same or very similar conditions as those under which the production run that is to be controlled is printed.

The color chart contains both combination measuring patches of two or all three colors and the corresponding single-color measuring patches. If the combination measuring patches are scanned by the same densitometer that is used during the run, three measurement data (a so-called triplet of numbers) can be obtained for each of the half-tone step combinations given by way of example above, which give falsified screen dot densities for the three inks, cyan, magenta and yellow. By a similar scanning of the single-color measuring patches, an additional, unfalsified number triplet can be obtained, which also shows the screen dot densities for the three colors, but for the case in which the three printing colors were scanned separately. The two number triplets differ from one another according to the variations which are obtained, as described above, also during the run, on the basis of the scanning of combination measuring patches. It is therefore possible to read from the color chart or color table what changes a number triplet obtained at single-color measuring patches will undergo if it is obtained by scanning a combination measuring field, or in what manner number triplets obtained at combination measuring patches must be corrected in order to obtain from them the values corresponding to the unfalsified triplets.

During the run, and whenever control of the printing run is necessary or desired, selected combination measuring patches printed together with the picture on the margin of the paper in accordance with FIGS. 8 or 9, are measured by means of the densitometer, and a falsified number triplet is likewise obtained in each case. For this number triplet, the identical or closest number triplet, likewise obtained on a combination measuring patch and therefore likewise falsified, is looked up on the color chart. For the controlling operation, however, not this number triplet, but the correct number triplet obtained at single-color measuring patches is used, which is also to be seen in the chart, and which corresponds to the actual circumstances, and which contains the data referred to herein as "corrected measurement data." From comparison in this manner, however, and according to the composition of the chart, not only can the correct or corrected absolute screen dot densities be obtained, but also all of the factors that can be derived from these screen dot densities, such as the changes in the area of the screen dots during the run or with respect to the original single-color strips, the distance of a particular color shade from a preselected neutral point, any of the selected equations, or the like.

The color charts or color tables are best prepared under the same or similar conditions as in the production run. This means that similar papers and similar inks are used. The various papers can be divided into paper types which include papers of largely similar performance, so that just a few, e.g., three color charts corresponding to three types of paper should suffice. As far as the inks are concerned, if standardized printing inks are used, no additional color charts are required, but if nonstandardized inks are used they might also prove desirable. Other reasons in addition to paper and ink differences may contribute to the need for additional color charts. Similar tables can also be prepared with solid patches if only one or one more control based on solid density measurement data is desired. Lastly, special color charts or tables can be provided which contain only the data on the selected equations.

A special advantage of the color charts described is that it is possible by looking up the number triplet obtained by scanning a combination measuring patch to know immediately whether the given tolerances have been maintained in the run or whether a corrective intervention must be made. If such visual-mechanical control by an operator is undesirable, the number triplets from the color table can also be stored in a memory of a computer and the measurement data can be repeatedly fed to it. In this case a computer program takes over the task of finding the corresponding triplets in the color chart, correcting the triplets and, if necessary, performing the adjustment or working up a recommendation for the adjustment. The correction might be performed, for example, by means of the computer units 91 and 99 which can be seen in FIG. 7, and a separate memory can be provided for the color table, or the approximation formulas can be contained in the program stored in memory 81 (FIGS. 5 and 6).

An example of how the corrected data can be obtained by comparing data obtained from combination measuring patches is represented in FIGS. 10 to 13, all representing small sections of color tables. FIG. 10 shows the half-tone steps which are shown by the positive halftone films that were used in making the printing forms. In the upper left corner, for example, is a triplet of numbers giving the halftone steps C=cyan=48%, M=magenta=38%, and Y=yellow=40%. FIG. 11 shows the same section from the color table, but the screen densities measured at single-color screen patches for the number triplets. The triplet of numbers in the upper left corner thus shows that the triplet 48/38/40 of FIG. 10 leads after printing to a triplet with the screen densities 0.51, 0.40 and 0.42 for the three chromatic printing inks, respectively. The triplet 0.51/0.40/0.42 is thus referred to as the correct triplet. From the data given in FIG. 11, it is possible by means of the Murray-Davies formula to compute, if necessary, the corresponding optically active area coverages which are given in FIG. 12 in the same order.

Lastly, FIG. 13 shows, again in the same order, the data which are obtained from combination measuring patches after printing if the corresponding halftone steps according to FIG. 10 are used in producing the printing forms. From this it can be seen that values of 0.57/0.59/0.64 are obtained for the triplet in the upper left corner, which differ considerably from the corresponding values of FIG. 11, obtained from single-color measuring patches. Therefore, if, in spite of the use of combination measuring patches, a correct control is to be exercised, it is necessary to correct the measurement data obtained from FIG. 13, by replacing them with the associated and correct values from FIG. 11, automatically, for example, by means of a computer. A comparison of FIGS. 11 and 13 does show that the interrelated number triplets show quite unexpected differences, so that, without the color tables, it is not always possible to estimate accurately how the data from FIG. 13 have to be corrected. For this reason it is also difficult to find valid approximation formulas for the correction of the measuring data of FIG. 13.

It can furthermore be seen from FIGS. 10, 11 and 13 what errors would occur if the number triplets of FIG. 13 were to be taken as the basis. If, for example, in FIG. 11, the top left triplet is compared with the top right triplet, it will be seen that there is a change of density only in regard to the magenta color, namely from 0.40 to 0.44. This is in good agreement with FIG. 10, since there, too, a change in the halftone step from 38% to 42% is provided only for the color magenta. FIG. 13, on the other hand, shows that, in the corresponding triplet, there was not only a change from 0.59 to 0.64 for the color magenta, i.e., slightly more than indicated in FIG. 11, but that a change from 0.64 to 0.66 is indicated in regard to the color yellow. If the pressman were to use only the data from FIG. 13 for the control, he would erroneously attempt to change the value for magenta more than is needed, and also to change the value for yellow, although there is no need of it. A comparison with FIG. 11 shows the pressman, however, that only the value for the color magenta needs to be changed, and the change can be smaller than indicated by the two number triplets selected in FIG. 13, for example. The color tables or other aids therefore make it possible to utilize the combination measuring patches, which are very advantageous for other reasons, also for a controlling action, and to obtain from the data read from them the correct data which heretofore have been obtainable only by measurements on single-color measuring patches.

Similar tables and comparisons can be made for the selected equations, instead of the absolute values of the screen or solid densities, such as for example the screen density differences, by computing and comparing the differences for C−M, C−Y and M−G from the data of FIGS. 11 and 13. From such computations and comparisons it is found that the deviations of the differences and other selected equations are smaller, as a rule, or at least show a certain regularity, so that approximation formulas can be relatively easily developed making the use of color charts or tables superfluous.

If a measurement on a combination measuring patch results in a triplet which does not occur in the color table, e.g., C=0.569, M=0.59 and Y=0.635, then a triplet having all three values in best agreement with these measurements is looked up in the table. In the above example, this is the case with the triplet in the upper left corner. Aside from this, the color tables of FIGS. 10 to 13 can, of course, be combined into a single table in which still other useful values can be included as well.

In colorimetry, the subjective judgment of color differences, i.e, the judgment dependent upon the individual observer's subjective perception, is quantified with the aid of known formulas such as the CIELAB, CIE-USC, Hunter or the like. The color distance is defined as the distance separating two color points in the color space. On the other hand, with regard to the perception of pictures, the invention sets out from the surprising discovery that such judgments of color distances can be reasonably applied only when selected color shades are compared with adjacent color shades and no contrasts are active. In the judgment of a picture, this is not the case, as a rule, since pictures have more or less strong contrasts which very greatly control the subjective evaluation of color distances.

A subjective quantitative evaluation of color distances in pictures in the presence of contrast has not been possible in the past. However, for the better establishment of tolerances for the above-described or any other control technique it would be very useful to know what color distances in any picture are barely perceived a acceptable. To this extent the invention proposes the following procedure.

First a test picture is selected which in its contrast is representative of a group of pictures of the same or similar contrast ratios. Reproductions and a trial print of this test picture are prepared (see for example sample B, subject: "Place de la Concorde," or sample C, subject: vases, in the appended color brochure, "System Brunner PCP Picture Contrast Profile"). If this sample print is declared by the average observer to be color-correct, i.e., identical to the test picture, variants having preselected color distances are prepared from this test picture. These variants are characterized by the fact that, for example, the area coverage of the screen dots of each variant differs from the area coverages of the screen dots of the sample print considered to be color-correct by an established amount of, for example, 2%, 4% or the like, these differences being related in each case to a preselected halftone step, e.g., the 50% step. The variations for the rest of the steps result from this in a known manner. In order for these variants to be meaningful, great accuracy must be maintained in preparing them. To this end, for example, the area coverages of the screen dots of halftone films are varied photographically in a preselected manner by the contact method, and accuracies of preferably at least 0.5% are maintained in the middle shades. It is desirable in this manner to produce several films with different color distances for the individual color separations of the chromatic primary colors cyan, magenta and yellow; the gradations can or should be made where a critical acceptance limit is presumed for the average observer. In the samples B and C, the picture in the upper left is the color-correct test print, the other three pictures are variants.

The variants with the known color distances are then preferably submitted to a number of observers individually, with the request that each variant that can still be accepted be identified. From the replies of the different observers an average is formed, which is then considered typical in the judging of all pictures which have the same or similar contrast ratios as the test picture. Since it is known what color distances are associated with the individual variants, the desired values for the tolerances can be derived directly from them.

Careful quantitative studies by means of the described method have shown that, in pictures which are characterized by strong contrasts, much greater changes in the color distances are tolerable than has heretofore been assumed, so that such relatively wide tolerances can be associated with such types of pictures without having these types of pictures declared unacceptable from the perception point of view. On the other hand, in the case of low-contrast pictures, tolerances are to be provided which are as much as three times narrower than those of high-contrast pictures.

In the case of very low-contrast pictures, which are composed chiefly of achromatic shades, color differences which are caused by differences in the screen dot variations in the three primary colors of the order of 3% to 4% lead to color distances which are perceived by the observer as being at the borderline of acceptability. Very high-contrast pictures, however, which are composed mainly of pure, intense colors complementary to one another, are not perceived as being at the borderline of acceptability until color distances are reached which are caused by differences in the screen dot variations in the three primary colors of the order of 10% to 12%.

To avoid having to make a great number of variants having preselected color distances for a great number of test pictures, it is proposed according to the invention to divide a small number of carefully selected, typical test pictures into a number of picture contrast classes, so that in each picture contrast class a number of typical pictures are contained, with different subjects, but with the same or similar contrast ratios. Since technicians in the field of reproduction and printing are accustomed, on the basis of their experience, to classify pictures with similar contrast ratios, they too are in the position to assign any other picture to be reproduced or printed to one of the picture contrast classes. At the same time the variants per test picture can be limited to a small number, e.g. 3.

Lastly, in accordance with the invention, tolerances are associated with the individual classes of picture contrast for the control method of the invention described above. In this manner it is sufficient to assign a picture that is to be reproduced or printed to one of the available picture contrast classes and to use the quantitative tolerances associated with the particular class of picture contrast for the process used in controlling the printing.

The described process offers the important advantage that the technician can enable the customer to see, on the basis of the test pictures and their variants, what color variations are possible in the print. Since at the same time the tolerances to be maintained in the print can be read from the picture contrast class associated with the picture, the technician can also immediately give the customer a bid on the costs to be expected for his job, because they are determined substantially by the tolerances ranges that must be maintained. Finally, in the case of pictures in which relatively wide tolerances might be permitted, the customer, knowing the higher cost, can nevertheless ask for closer tolerances, or can refrain from very narrow tolerances on account of the anticipated high cost, and select a picture contrast class with wider tolerance ranges.

Figure 14:
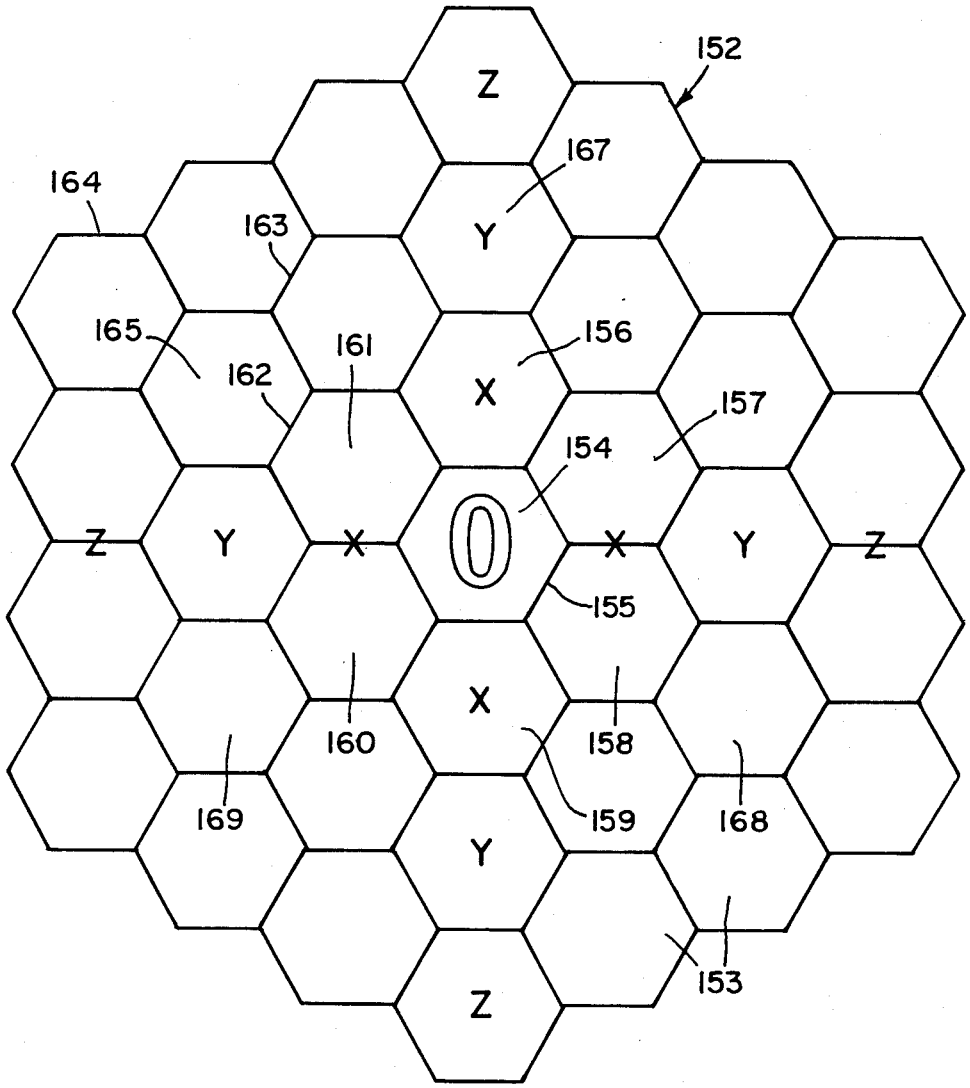
FIG. 14 shows a device for determining the color balance in the printing result of a offset printing press.

FIG. 14 and the appended sample A (see the appended color brochure) show a device for determining the color balance in a print made by a multicolor offset printing press, and for demonstrating the picture contrast classes. The device consists of a hexagon 152, which is composed of a plurality of small control elements 153 arranged about a central control element 154 defining neutral point, which is circumscribed by an outline 155. The control elements 153 consist preferably of hexagons of equal size which are contiguous with one another. A first group of six control elements 156 to 161 encircles the central control element 154, and this group is circumscribed by an outline 162. The first group is encircled by the control elements 154 of a second group, and this second group is circumscribed by an outline 163, and is in turn encircled by a third group of eighteen control elements circumscribed by an outline 164.

The central control element 154 is produced by the overprinting of three single-color patches of the three printing colors cyan, magenta and yellow, a particular combination of halftone steps being selected which is to constitute the neutral point of the gray balance or of the color balance during printing. For example, in the halftone film used in making the printing form, the 50% step is intended for the color cyan, and the 41% step for each of the colors magenta and yellow.

The control elements 156 to 161 representing selected color shades and surrounding the control element 154 have, on the other hand, halftone steps which differ from those of the neutral point in a different, but defined manner. For example, the upper control element 156 is characterized by a screen dot enlargement of 2% in magenta and a screen dot reduction of 2% each in the cyan and yellow. The bottom control element 159 is characterized by a screen dot reduction in magenta of 2%, and screen dot enlargements of 2% in each of cyan and yellow. The upper left control element 11 has a screen dot reduction of 2% in the yellow and screen dot enlargements of 2% in the magenta and cyan, but the lower right control element 158 has a screen dot enlargement of 2% in the yellow, and screen dot enlargements of 2% in the magenta and cyan. Lastly, the control elements 160 and 157 are characterized by corresponding screen dot enlargements and reductions of 2% each in the cyan, and corresponding screen dot reductions and enlargements of 2% each in the magenta and yellow. The control elements 156 to 161 of the first group are thus characterized by the fact that the area coverages of the screen dots in the halftone film differ from those of the central control element 154 by precisely +2% or −2%.

These differences in the absolute values of the halftone steps or of the screen dot sizes are only of limited suitability for the definition of tolerances in the control of a multicolor printing press, especially multicolor offset printing presses, for the reasons stated above. Moreover, for each defined neutral point a separate hexagon 152 must be prepared, even if the halftone steps of the colors cyan, magenta and yellow forming the neutral point were to be varied in the same direction and by the same amount, and, for example, if, instead of the above-defined neutral point with the halftone steps of 50%, 41% and 41%, a neutral point were to be provided having the halftone steps 52%, 43% and 43% for the colors cyan, magenta and yellow.

According to the invention, the proposed control strategy is based on the idea that a color shade changes only slightly if the halftone steps of all participating colors vary in the same direction. This is true accordingly also of the particular neutral gray point, and especially within certain limits. Therefore, it is not the absolute values of the screen dot sizes that are associated with the control elements 156 to 161 of the first group, but the selected equations derived therefrom, for example the preferentially applied differences, while the halftone steps of the control element 154 are given the value of zero, so that, instead of C=50%, M=41% and Y=41%, the values are now C=0%, M =0% and Y=0%. If the difference C−M is identified as B1, the difference C−Y as B2 and the difference M−7=B3, then the following associations result:

| | |
|---|---|
| Control element 156 | B1 = −4% |
| | B2 = 0% |
| | B3 = +4%, |
| control element 157 | B1 = −4% |
| | B2 = −4% |
| | B3 = 0%, |
| and control element 158 | B1 = 0% |
| | B2 = −4% |
| | B3 = −4%. |

The differences B1, B2 and B3 can be calculated for the control elements 159, 160 and 161 in the same manner. These associations thus signify that the differences B1, B2 and B3 within the first group differ by a maximum of +4% or −4% from those of the central control element 154, for whose differences B1=B2=B3=0, as defined, independently of their actual value.

The first group, which contains the control elements 156 to 161, is the picture contrast class X. This simultaneously signifies that picture contrast class X is to cover all those pictures in which the differences B1, B2 and B3 must differ by not more than ±4% of the selected neutral gray during the printing, and therefore the tolerance for the selected equations is set at ±4% in their production.

Likewise, the control elements of the second group, surrounded by the outline 163, can be produced by changing the area coverage of the screen dots by ±4% each. The control elements thus obtained will be associated likewise with differences B1, B2 and B3. Furthermore, the second group will be considered as picture contrast class Y, so that to it will belong all pictures in which the differences B1, B2 and B3 must not change during printing by more than ±8% with respect to the selected neutral point, and in producing them, therefore, the tolerances for the selected equations (here the differences b1, b2 and B3) are adjusted to ±8%.

In the third group surrounded by the outline 164, the changes in the area coverages accordingly amount to ±6%, which results in tolerances of ±12% for B1, B2 and B3. This group is called picture contrast class Z.

Figure 15:
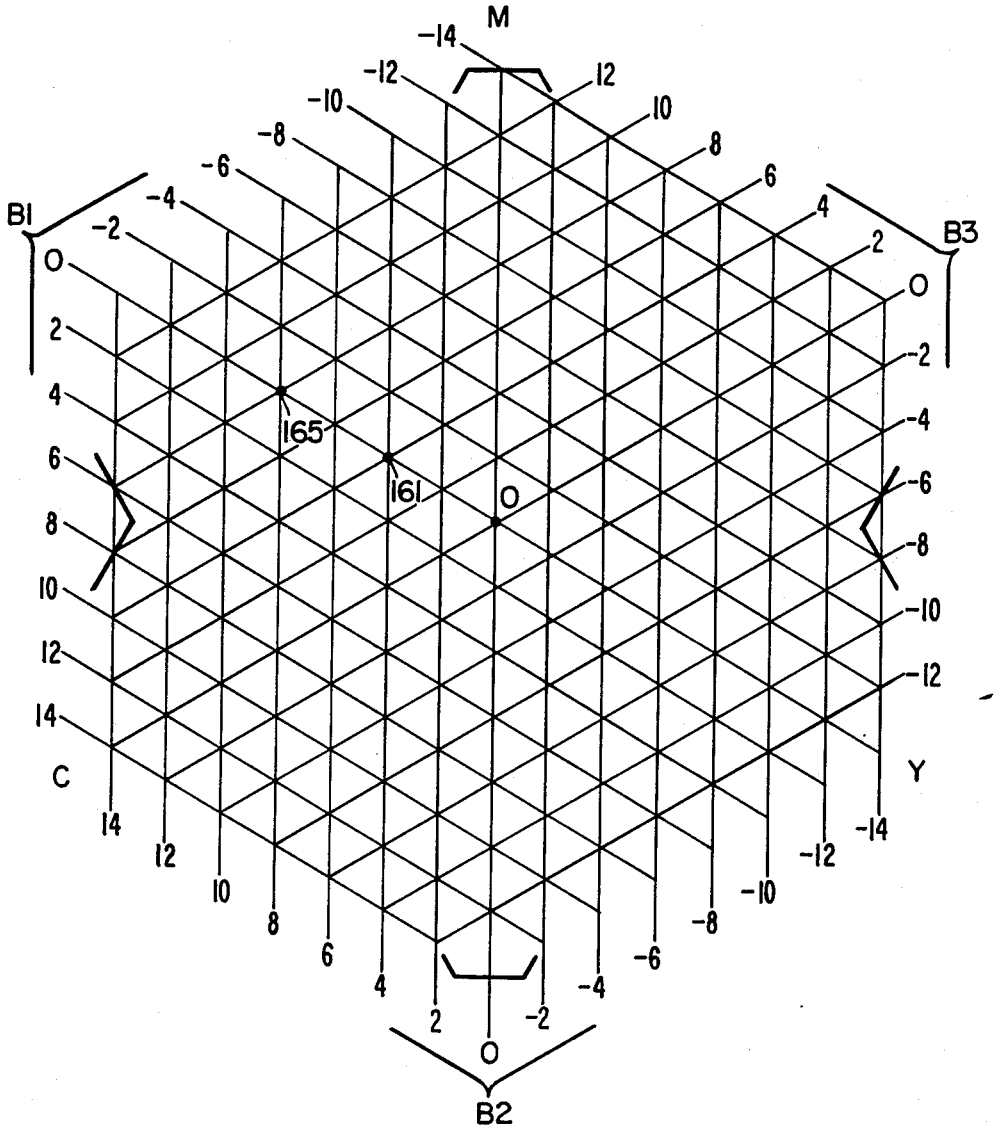
FIG. 15 represents a system of coordinates for the device according to FIG. 14, Sample A is a color representation of the device according to FIG. 14, and Samples B to D are color prints for the explanation of the apparatus according to FIG. 14, in conjunction with color contrast classes.

Another advantage of the hexagon 152 is that its control elements are or can be produced precisely the same as the combination measuring patches in the print control strip (cf. FIGS. 8 and 9) and under the same conditions. Therefore, the pressman can associate a combination measuring patch of the print control strip visually with the control element that best matches it in the hexagon 152, and can estimate directly the distance of the combination measuring patch from the defined neutral point or recognize whether the printed combination measuring patch is still within the tolerance. The coordination system seen in FIG. 15 can serve as an additional aid. In this system, the lines between the letters M and C represent the values of B1, the lines between the letters C and Y the values of B2, and the lines between the letters Y and M the values of B3. If, therefore, a combination measuring patch on the print control strip, for example, matches in shade a control element 165 of the hexagon, it is possible by superimposing the coordination system of FIG. 15 onto the hexagon 152 to see directly that the values B1=0, B2=8 and B3=8 are associated with the shade and therefore it is necessary to enter a correction in the printing process if it so happens that a picture is being printed which is in picture contrast class X.

If on a combination measuring patch on the print control strip the measurements C=+4%, M=+4% and Y=0% are made, the result will be the values B1=0, B2=4 and B3=4. By means of the coordinate system it is found that the control element 161 is associated with this combination measuring patch. From this the pressman can see that the tolerance has not yet been exceeded in the printing, if the picture is one that belongs in picture contrast class X. If, instead of the selected equations, one were to use the absolute values of the screen dot size, a departure from the tolerance would be erroneously indicated, because within the picture contrast class X the departures of the screen dot sizes from the neutral point amount to a maximum of ±2%, but the cyan and magenta departures measure +4%.

Instead of the selected neutral point with the steps 50%, 41% and 41%, neutral points with any other steps can be selected. Such a neutral point can be any control element 153 of the hexagon 152, since in such a case only the numerical values for the special equations B1, B2 and B3 need to be changed, as it is easy to see by superimposing the coordinate system of FIG. 15, if its neutral point is laid not on the center control element 154 but on any other control element. It is possible with the coordinate system to associate with each individual control element of the hexagon 152 a definite triplet of numbers for the values B1, B2 and B3. If the hexagon 152 is made in different steps, then the coordinate system is to be modified accordingly. The same can apply if instead of hexagons other forms, e.g., circles, are provided or if an entirely different spatial arrangement is selected instead of the spatial arrangement of the control elements seen in FIG. 14.

In the appended samples B and C (see the appended color brochure), the color-correct printed product is represented at the upper left. In the picture at the upper right the magenta content is increased by 4%, while the contents of the other two colors is reduced by 4%. In the picture at the bottom right the yellow content is increased by 4%, while the contents of the other colors ar reduced each by 4%. Lastly, in the picture at the lower left the cyan content is increased by 4%, while the magenta and yellow contents are reduced by 4%. In the hexagon 152, therefore, the control elements 154, 167, 168 and 169 are associated in these four pictures with the picture contrast class Y. Sample D (see appended color brochure) shows in the center a picture corresponding to the central control element 154 of hexagon 152 and another six pictures which are associated with the control elements 156 to 161 and thus with picture contrast class X in the hexagon.

Studies of samples B, C and D have shown that the average observer accepts only those variations in sample D (girl) which are produced by the narrow tolerances of picture contrast class X. On the other hand, the color variations in sample C (vases) are easily accepted. Even the color variations of picture contrast class Z, with their wide tolerances, are still acceptable here. Lastly, the variants in sample B (Place de la Concorde) display-excessive variations and would be accepted only with the tolerances associated with picture contrast class X. The result is that samples B and D are subjects for picture contrast class X, while sample C is a subject for picture contrast class Z.

Otherwise, the tolerances associated with the picture contrast classes can be freely selected and adapted to the particular requirements. The classification system described is only one example. Furthermore, more or less than three picture contrast classes can be selected, and the steps between the individual picture contrast classes can be selected differently. Furthermore, the hexagon 152 can be replaced by a device in which the control elements consist of overprinted solid patches instead of screen patches. It would furthermore be possible to associate different selected equations with the individual control elements or to convert the differences in the screen dot sizes to different values. Also, it would be conceivable to make devices of a similar kind which are formed by the overprinting of more or less than three single color patches.

The invention, lastly, is not limited to the examples described, which can be modified in many ways.

I claim:

1. A method of operating a multicolor printing press having a plurality of printing units for printing a multicolor picture composed of color picture elements too small for the human eye to dissolve, each unit having an ink foundation for feeding one of a plurality of different printing inks onto a substrate, and also having a plurality of adjustable ink regulating means for controlling feeding of said inks onto a plurality of adjacent zones of said substrate; said method comprising the steps of: successively printing a plurality of pictures with said inks onto said substrate; successively printing measuring patches with said inks onto said substrate such that said inks within said patches have characteristics of a group of characteristics containing at least one of the following: solid density and screen dot sizes; repeatedly determining said characteristics of said inks within said patches; repeatedly determining selected relationships between the characteristics of different inks within said patches; associating first tolerance ranges with said relationships; determining whether said relationships are inside or outside said first tolerance ranges; and controlling said regulating means such that said relationships fall within said first tolerance ranges, to thereby achieve uniform printing of said pictures.

2. A method according to claim 1, comprising interrupting printing of said pictures if one of said relationship falls outside said first tolerance range for a preselected period of time.

3. A method according to claim 1, wherein said selected relationships are differences between said characteristics.

4. A method according to claim 1, wherein said selected relationships are quotients of said characteristics.

5. A method according to claim 1, wherein said selected relationships are arithmetical averages of said characteristics.

6. A method according to claim 1, wherein said patches are printed with said inks in the form of solid surfaces.

7. A method according to claim 1, wherein said patches are printed with said inks in the form of screen dot surfaces.

8. A method according to claim 1, comprising: printing said patches with said inks in the form of solid and screen dot surfaces, repeatedly determining actual correlations between said solid densities and said screen dot sizes of said patches, and controlling said ink regulating means also depending on said correlations.

9. A method according to claim 1, comprising: associating second tolerance ranges with said characteristics, determining whether said characteristics of said patches are inside or outside said second tolerance ranges, and interrupting said printing of said pictures if one of said characteristics falls outside said second tolerance range for a preselected period of time.

10. A method according to claim 1, wherein said ink regulating means are controlled such that the relationships closely approach preselected guidance values, said guidance values being inside said first tolerance ranges.

11. A method according to claim 9, wherein said ink regulating means are controlled such that said characteristics closely approach preselected guidance values, said guidance values being inside said second tolerance ranges.

12. A method according to claim 1, comprising: selecting for the printed pictures a selected one of a plurality of possible quality classes, providing a plurality of sets of first tolerance ranges, each set being associated with one of said quality classes, and using the set associated with said selected quality class for printing said pictures.

13. A method according to claim 12, wherein said selected quality class is selected depending on contrast within the pictures to be printed.

14. A method according to claim 12, wherein a plurality of picture contrast classes are provided, each picture contrast class being representative of contrast between a plurality of test pictures having similar contrasts, associating with each picture contrast class one of said sets of first tolerance ranges, and using for printing of said pictures the set associated with the picture contrast class into which the pictures to be printed fall.

15. A method according to claim 1, comprising: overprinting patches of different inks in order to obtain combination measuring patches, densitometrically scanning said combination measuring patches for obtaining measuring signals, determining said characteristics and said relationships from said measuring signals, providing corrected values for said relationships in order to at least partially correct errors caused by overprinting said patches during scanning thereof, and controlling said ink regulating means depending on said corrected values for said relationships.

16. A method according to claim 1, comprising: overprinting patches of different inks in order to obtain combination measuring patches, densitometrically scanning said combination measuring patches for obtaining measuring signals, determining said characteristics from said measuring signals, providing corrected values for said characteristics in order to at least partially to correct errors caused by overprinting said patches during scanning thereof, and controlling said ink regulating means depending on said corrected values for said characteristics.

17. A method according to claim 15, wherein said corrected values for said relationships are obtained by approximation formulas.

18. A method according to claim 17, wherein said corrected values for said characteristics are obtained by approximation formulas.

* * * * *